US010801291B2

(12) United States Patent
Ross et al.

(10) Patent No.: US 10,801,291 B2
(45) Date of Patent: Oct. 13, 2020

(54) TUBING HANGER SYSTEM, AND METHOD OF TENSIONING PRODUCTION TUBING IN A WELLBORE

(71) Applicant: INNOVEX DOWNHOLE SOLUTIONS, INC., Houston, TX (US)

(72) Inventors: Stephen C. Ross, Odessa, TX (US); Orlando J. Hinds, Odessa, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 140 days.

(21) Appl. No.: 15/643,202

(22) Filed: Jul. 6, 2017

(65) Prior Publication Data

US 2018/0038186 A1 Feb. 8, 2018

Related U.S. Application Data

(60) Provisional application No. 62/370,524, filed on Aug. 3, 2016.

(51) Int. Cl.
*E21B 33/04* (2006.01)
*E21B 33/068* (2006.01)
(Continued)

(52) U.S. Cl.
CPC ..... *E21B 33/0422* (2013.01); *E21B 17/042* (2013.01); *E21B 19/10* (2013.01); *E21B 33/068* (2013.01)

(58) Field of Classification Search
CPC ..... E21B 33/04; E21B 33/068; E21B 17/042; E21B 19/10
See application file for complete search history.

(56) References Cited

U.S. PATENT DOCUMENTS 1,922,024 A 8/1933 Bouslog
3,011,552 A 12/1961 Rhodes et al.
(Continued)

OTHER PUBLICATIONS

Office Action for Canadian patent app. No. 2,973,027, dated Mar. 28, 2019.

(Continued)

*Primary Examiner* — Taras P Bemko
*Assistant Examiner* — Dany E Akakpo
(74) *Attorney, Agent, or Firm* — Mh2 Technology Law Group LLP

(57) ABSTRACT

A tubing hanger system for suspending a tubing string within a wellbore is provided. The system is designed to place the tubing string in tension. The tubing hanger system comprises a tubing hanger and a tubing anchor. Both the tubing hanger and the tubing anchor are designed to reside in series with the production tubing. The tubing hanger is threadedly connected to the tubing string at the top of the wellbore. The tubing anchor is also threadedly connected to the tubing string but is configured to be set within a string of casing downhole. Beneficially, the tubing hanger and the tubing anchor is each uniquely configured to be set through a rotation of the tubing string that is less than one full rotation. This enables use of a stainless steel chemical injection line extending from the tubing hanger to the tubing anchor. A method for hanging a string of production tubing in a wellbore, in tension, is also provided herein.

25 Claims, 13 Drawing Sheets

(51) Int. Cl.
*E21B 19/10* (2006.01)
*E21B 17/042* (2006.01)

(56) References Cited

U.S. PATENT DOCUMENTS 3,494,638 A 2/1970 Todd et al.
4,171,018 A 10/1979 Walker
4,202,410 A 5/1980 Quebe
4,278,278 A 7/1981 Chambless et al.
4,605,063 A * 8/1986 Ross ..... E21B 23/01 166/216
5,103,900 A 4/1992 McLeod et al.
5,139,090 A * 8/1992 Land ..... E21B 23/01 166/117.7
5,465,794 A 11/1995 McConaughy et al.
6,415,863 B1 7/2002 Hudson et al.
6,516,887 B2 2/2003 Nguyen et al.
6,530,433 B2 3/2003 Smith et al.
6,688,386 B2 2/2004 Cornelssen et al.
7,552,762 B2 6/2009 Khazanovich et al.
8,291,986 B2 10/2012 Gorrara et al.
9,624,747 B2 4/2017 Kajaria et al.
2005/0263293 A1 12/2005 Tessler et al.
2011/0005774 A1 1/2011 Sinnott et al.
2011/0226488 A1 9/2011 Garcia
2012/0012335 A1 1/2012 White et al.
2013/0020095 A1 1/2013 Vanderford
2014/0151069 A1* 6/2014 Kajaria ..... E21B 33/047 166/382
2016/0076329 A1 3/2016 Nguyen et al.

OTHER PUBLICATIONS

Logan Kline Tools Tubing Anchor, published prior to Aug. 3, 2016.

* cited by examiner

TUBING HANGER SYSTEM, AND METHOD OF TENSIONING PRODUCTION TUBING IN A WELLBORE

CROSS REFERENCE TO RELATED APPLICATIONS

This application claims the benefit of U.S. Ser. No. 62/370,524 filed Aug. 3, 2016. That application is entitled "Tubing Hanger System, And Method Of Tensioning Production Tubing In A Wellbore," and is incorporated herein in its entirety by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Field of the Invention

The present disclosure relates to the field of hydrocarbon recovery operations. More specifically, the present invention relates to a system for hanging a string of production tubing in a wellbore without applying appreciable torque to a banded chemical injection line downhole. The invention also relates to a method of hanging production tubing in a wellbore, in tension.

Technology in the Field of the Invention

In the drilling of oil and gas wells, a wellbore is formed using a drill bit that is urged downwardly at a lower end of a drill string. The drill bit is rotated while force is applied through the drill string and against the rock face of the formation being drilled. After drilling to a predetermined depth, the drill string and bit are removed and the wellbore is lined with a string of casing. An annular area is thus formed between the string of casing and the formation. A cementing operation is typically conducted in order to fill or "squeeze" the annular area with cement. The combination of cement and casing strengthens the wellbore and facilitates the isolation of zones behind the casing for the production of hydrocarbons.

It is common to place several strings of casing having progressively smaller outer diameters into the wellbore. In this respect, the process of drilling and then cementing progressively smaller strings of casing is repeated several times until the well has reached total depth. The final string of casing, referred to as a production casing, is typically cemented into place.

As part of the completion process, the production casing is perforated at a desired level. Alternatively, a sand screen may be employed in the event of an open hole completion. Either option provides fluid communication between the wellbore and a selected zone in a formation. In addition, production equipment such as a string of production tubing, a packer and a pump may be installed within the wellbore.

As part of the completion process, a wellhead is installed at the surface. The wellhead includes a tubing-hanger used to gravitationally support the production tubing. Fluid gathering and processing equipment such as pipes, valves and separators are also provided. Production operations may then commence.

During the production process, the production tubing may experience thermal expansion over time. This is due to the presence of warm production fluids being produced up through the pipe and to the surface. To offset the anticipated expansion, it is known to place the production tubing under some degree of tension when the well is completed. This will maintain the production tubing in a linear state even while the pipe string relaxes in response to thermal expansion.

Typically, the tubing string may be tensioned approximately one inch for every 1,000 feet of tubing in order to minimize buckling. This way the travel distance associated with the expansion will be less than the distance the tubing is stretched during tensioning. Thus, even when the tubing expands over time, the tubing does not buckle within the wellbore during the production process but remains somewhat taut. This is of particular benefit when the wellbore is being rod pumped as pre-tensioning minimizes frictional engagement between the rod string and the surrounding production tubing.

In connection with hanging the tubing in the wellbore, it is also sometimes desirable to provide a fluid supply line such as a chemical injection line into the well. The chemical injection line extends from the tubing hanger at the surface, and down to a packer or pump downhole. Most existing tubing tensioning arrangements prevent the use of a fluid supply line that will descend through and below the tubing hanger. Moreover, known tubing hangers generally require that the tubing string be rotated or turned five or more times in connection with setting the tubing anchor and locking the tubing hanger. However, stainless steel chemical injection lines cannot tolerate the stress and tension induced by rotation of the tubing string.

Accordingly, a need exists for a tubing hanger that enables hanging tubing from a tubing head at the surface with less than one complete rotation of the production string from the surface. Further, a need exists for a tubing hanging system that is able to accommodate a chemical injection line being run down to the tubing anchor within the wellbore. Still further, a need exists for a tubing anchor/catcher that allows slips to be actuated to engage the surrounding casing with less than a full tubing rotation

SUMMARY OF THE INVENTION

A tubing hanger system for suspending a tubing string within a wellbore is provided. The system is designed to hold the tubing string in tension within the wellbore. The tubing hanger system comprises a tubing hanger and a separate tubing anchor. Both the tubing hanger and the tubing anchor are designed to reside in series with the production tubing.

The tubing hanger is threadedly connected to the tubing string at an upper end of the tubing string, and is configured to reside within a tubing head over the wellbore. The tubing hanger comprises a short tubular assembly having an inner diameter, an outer diameter, and a bore extending along its length. The tubing hanger also has a beveled shoulder along the outer diameter which is configured to land on a matching conical surface machined along the tubing head. Upon landing, the tubing hanger gravitationally supports the tubing string in tension.

The tubing anchor is also threadedly connected to the tubing string. Specifically, the tubing anchor is threadedly connected to the tubing string proximate a lower end of the tubing string. Thus, the tubing anchor resides within a string of production casing downhole. The result is that the tubing hanger is at the upper end of the tubing string and the tubing hanger is proximate a lower end of the tubing string.

Beneficially, the tubing hanger and the tubing anchor are each configured to be set through a rotation of the tubing string that is less than one full rotation. The tubing hanger is set in the tubing head, while the tubing anchor is set downhole in production casing. This enables use of a stainless steel chemical injection line extending from the tubing hanger to the tubing anchor.

In one aspect, the tubing hanger comprises a tubular assembly and a mandrel assembly. The tubular assembly comprises:

- a cylindrical interlocking top ring,
- a cylindrical interlocking bottom ring configured to reside below the interlocking top ring, and having a series of splines extending down from an inner diameter thereof; and
- a cylindrical chemical injection ring configured to generally reside below the interlocking bottom ring and around the series of splines.

Of interest, the beveled shoulder resides along a bottom end of the interlocking bottom ring.

The mandrel assembly defines a tubular body that is configured to be slidably received within the bore of the tubular assembly. In one aspect, the mandrel assembly comprises:

- an upper end having female threads and configured to extend above the tubular assembly when the tubing hanger lands on the conical surface of the tubing head;
- a lower end also having female threads and configured to be threadedly connected to an upper joint of the tubing string; and
- angled shoulders spaced radially around an outer diameter of the mandrel assembly configured to pass between the splines of the tubular assembly, but to receive and interlock with individual splines of the series of splines when the mandrel assembly is rotated the less than one full rotation, and then set down.

In one embodiment, the mandrel assembly comprises:

- a top mandrel providing the female threads at the upper end; and
- a separate bottom mandrel providing the female threads at the lower end;
- wherein the angled shoulders reside about a cylindrical body forming the top mandrel.

During completion, the tubular assembly is placed along an inner diameter of the tubing head. As noted, the beveled shoulder of the tubular assembly will land on the conical surface machined into the inner diameter of the tubing head. The tubular assembly is then rotationally locked into place.

Next, the mandrel assembly is secured to the top joint of the production tubing. The mandrel assembly with connected production tubing is then lowered into the wellbore until the tubing anchor is at a desired location downhole. The tubing anchor is then set.

Next, the mandrel assembly is moved back up the wellbore in order to apply the desired tension to the production tubing. The angled shoulders of the bottom mandrel are lifted along the spaces provided between the splines of the cylindrical interlocking bottom ring. Once the angled shoulders have cleared the splines, the mandrel assembly is rotated less than 180 degrees, and the mandrel assembly is then set down onto the splines in order to lock the mandrel assembly and gravitationally supported tubing string in place. Preferably, a rotation of the mandrel assembly and connected tubing string by less than 180 degrees comprises a rotation of the mandrel assembly by a one-quarter turn clockwise relative to the bore of the tubular assembly.

The tubing hanger system may also comprise a channel machined through each of the interlocking top ring and the bottom mandrel along a longitudinal axis. The channel is designed to carry an injection fluid. A fitting may be provided at a lower end of the channel. The fitting is machined into the bottom mandrel for sealingly receiving a top end of a chemical injection line. The chemical injection line extends downhole from the fitting to the tubing anchor. In this way, a chemical treatment fluid may be injected into the channel and then into the chemical injection line, where it is transmitted downhole to the tubing anchor.

As noted, the tubing hanger assembly also includes a tubing anchor. In one aspect, the tubing anchor comprises:

- an upper box connector for threadedly connecting the tubing anchor to the tubing string;
- a lower pin connector for threadedly connecting the tubing anchor to the tubing string;
- slips between the upper box connector and the lower pin connector configured to be mechanically actuated by applying tension to the tubing string; and
- a locking body having profiles configured to receive a pin and to hold the slips in engagement with the surrounding production casing upon rotation of the tubing string by less than 180 degrees;

wherein the locking body comprises a channel along an outer diameter dimensioned to mechanically connect to a lower end of the chemical injection line.

A method for hanging a string of production tubing in a wellbore, in tension, is also provided herein. The method employs the tubing hanger system as described above, in any of its various embodiments.

The method first includes providing a tubing hanger system. The tubing hanger system includes the tubing hanger and the tubing anchor, wherein the tubing hanger and the tubing anchor are each configured to be set through a rotation that is less than one full rotation.

The method also includes threadedly connecting a joint of production tubing to the tubing anchor. The method then includes running a string of production tubing into the wellbore, joint-by-joint, wherein the tubing anchor is threadedly connected to the production tubing proximate a lower end of the production tubing.

As part of the method, a steel chemical injection line is banded or clamped to the o.d. of the tubing joints. An upper end of the chemical injection line is connected to the channel at the lower end of the bottom mandrel. This may be by means of a compression fitting.

The method additionally includes threadedly connecting the tubing hanger to the string of production tubing at an upper end of the production tubing. The method then includes lowering the tubing hanger so as to land the tubing hanger onto a landing surface of the tubing head above the wellbore. Preferably, the landing surface of the tubing head comprises an inner conical surface machined into the inner diameter of the tubing head. In any instance, the tubing hanger gravitationally supports the production tubing.

The method further comprises setting the tubing anchor within a string of surrounding production casing within the wellbore. The method then includes applying tension to the tubing string.

In accordance with embodiments of the invention, the method additionally comprises setting the tubing hanger within a tubing head at a surface above the wellbore. In operation, a rotation of the mandrel assembly within the bore of the tubular assembly while the angled shoulders of the top mandrel are above the splines of the cylindrical interlocking bottom ring locks the tubing anchor in place within the production casing. This is followed by a rotation of the mandrel assembly and connected tubing string by less than 180 degrees, but sufficient to lock the mandrel assembly from further longitudinal movement within the wellbore.

The method may then include producing hydrocarbon fluids to the tubing hanger at the surface.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

Figure 1:
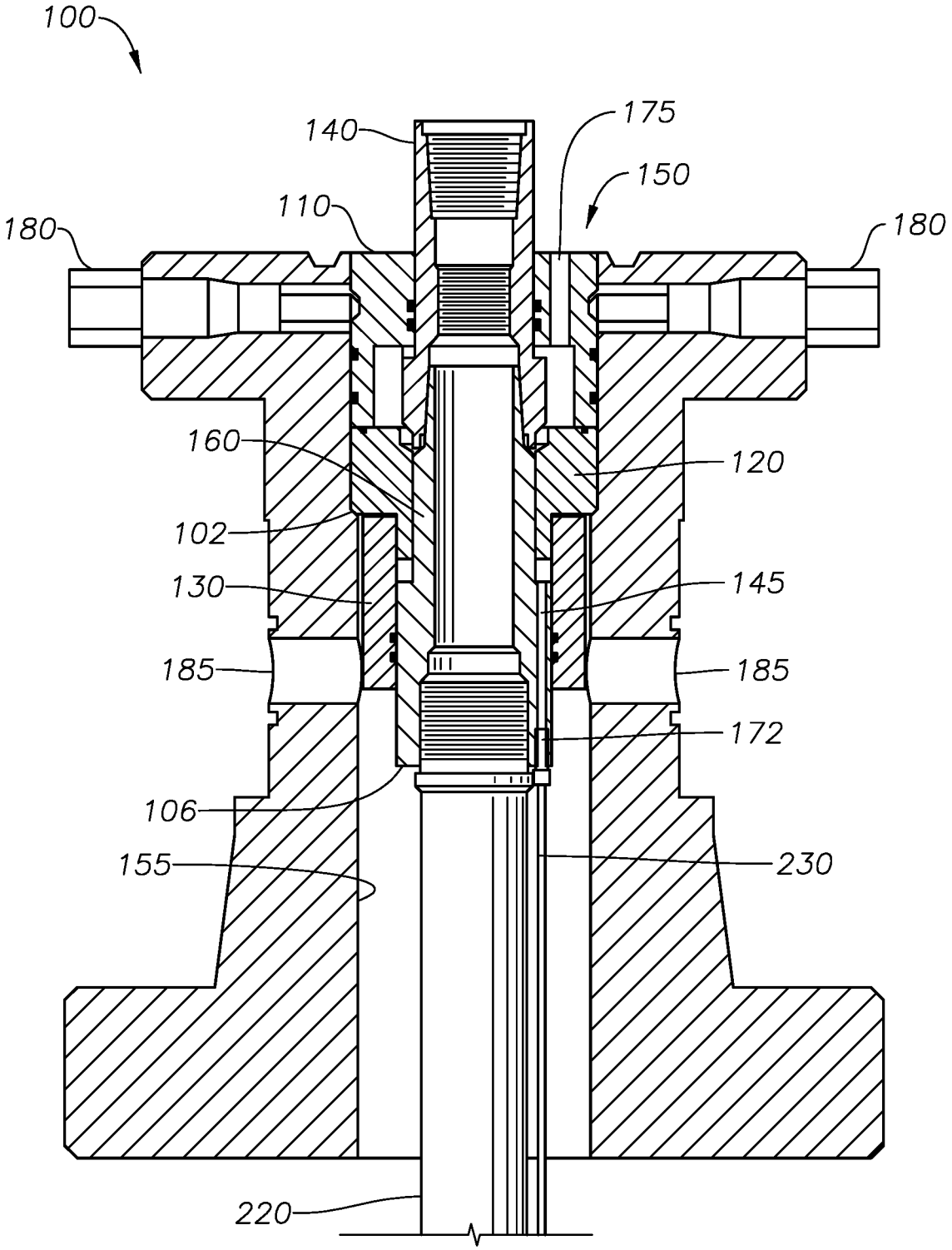
FIG. 1 is a cut-away view of a known tubing head for supporting a string of production tubing from the surface. Residing within an inner diameter of the tubing head is a tubing hanger of the present invention, in one embodiment. Also visible is a chemical injection line in fluid communication with the tubing hanger.

For purposes of the present application, it will be understood that the term "hydrocarbon" refers to an organic compound that includes primarily, if not exclusively, the elements hydrogen and carbon. Hydrocarbons may also include other elements, such as, but not limited to, halogens, metallic elements, nitrogen, oxygen, and/or sulfur.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient condition. Hydrocarbon fluids may include, for example, oil, natural gas, coalbed methane, shale oil, pyrolysis oil, pyrolysis gas, a pyrolysis product of coal, and other hydrocarbons that are in a gaseous or liquid state.

As used herein, the terms "produced fluids," "reservoir fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, oxygen, carbon dioxide, hydrogen sulfide and water.

As used herein, the term "fluid" refers to gases, liquids, and combinations of gases and liquids, as well as to combinations of gases and solids, combinations of liquids and solids, and combinations of gases, liquids, and solids.

As used herein, the term "wellbore fluids" means water, hydrocarbon fluids, formation fluids, or any other fluids that may be within a wellbore during a production operation.

As used herein, the term "gas" refers to a fluid that is in its vapor phase.

As used herein, the term "subsurface" refers to geologic strata occurring below the earth's surface.

As used herein, the term "formation" refers to any definable subsurface region regardless of size. The formation may contain one or more hydrocarbon-containing layers, one or more non-hydrocarbon containing layers, an overburden, and/or an underburden of any geologic formation. A formation can refer to a single set of related geologic strata of a specific rock type, or to a set of geologic strata of different rock types that contribute to or are encountered in, for example, without limitation, (i) the creation, generation and/or entrapment of hydrocarbons or minerals, and (ii) the execution of processes used to extract hydrocarbons or minerals from the subsurface.

As used herein, the term "wellbore" refers to a hole in the subsurface made by drilling or insertion of a conduit into the subsurface. A wellbore may have a substantially circular cross section, or other cross-sectional shapes. The term "well," when referring to an opening in the formation, may be used interchangeably with the term "wellbore." When used in connection with a drilling process, the term "bore" refers to the diametric opening formed in the subsurface.

DESCRIPTION OF SELECTED SPECIFIC EMBODIMENTS

A tubing hanger system is provided herein. The tubing hanger system includes a tubing hanger (or "tensioner") configured to reside at the wellhead, and a tubing anchor (or "catcher") configured to reside downhole. Ideally, the tubing anchor is positioned just above or adjacent a fluid pump. Together, the tubing hanger and the tubing anchor hold a string of production tubing in tension during the production of hydrocarbon fluids.

FIG. 1 is a cut-away view of a tubing head 100 for supporting a string of production tubing 220. The tubing head 100 is designed to reside at a surface. The surface may be a land surface; alternatively, the surface may be an ocean bottom or a lake bottom, or a production platform offshore. The tubing head 100 is designed to be part of a larger wellhead (not shown, but well-familiar to those of ordinary skill in the art) used to control and direct production fluids and to enable access to the "back side" of the tubing 220. The tubing head 100 provides an inner diameter, or bore 155, through which the string of production tubing 220 and downhole hardware are run.

Residing within the inner diameter 155 of the tubing head 100 is a tubing hanger 150 of the present invention, in one embodiment. The tubing hanger 150 is designed to gravitationally support the string of production tubing 220 from the surface. It is understood by those of ordinary skill in the art that by suspending the tubing string 220 from the surface, at least an upper portion of the tubing string 220 will reside in a state of tension.

It is observed that in long strings of jointed tubing, and particularly those in which a reciprocating pump is used, the portion of the tubing string 220 closest to a downhole tubing anchor will rest on an anchored pump barrel. This causes at least the lower portion of the tubing string 220 to go into compression. As thermal expansion occurs during the production of hot reservoir fluids, the string of production tubing 220 is further induced into compression. As noted above, this compression causes buckling along the wellbore which, in turn, causes premature wear of the rods and tubing during pump reciprocation. Accordingly, operators will pull the tubing string 220 into slight tension before "hanging," and then lock the tubing string 220 into place using the tubing hanger 150. In known systems, this locking procedure requires multiple rotations of the tubing string 220.

In the arrangement of FIG. 1, the tubing hanger 150 includes a series of components. These components include an interlocking top ring 110, an interlocking bottom ring 120, a chemical transfer ring 130, a top mandrel 140 and a bottom mandrel 160. These components are shown in exploded apart relation in FIG. 3, and are discussed below. Beneficially, these components permit the tubing string 220 to be locked in tension without multiple rotations.

It is noted that the tubing head 100 includes opposing lock pins 180. The lock pins 180 help secure the tubing string 220 in place within the bore 155. More specifically, the pins 180 lock in the interlocking top ring 110 which operatively supports the tubing string 220. This then allows a mandrel assembly (top mandrel 140 and bottom mandrel 160) to travel relative to a bore 205 of the well 200 (shown in FIG. 2) and relative to the bore 155 of the tubing head 100.

The tubing head 100 also includes one or more side outlets 185. The side outlets 185 are used during production to control annulus fluids and to allow access to the annulus by regulators during testing. Additionally, the tubing head 100 includes an injection conduit 175 for a treating fluid. The treating fluid may be, for example, a corrosion inhibitor. The injection conduit is in fluid communication with a chemical injection line 230 using, for example, a compression fitting 172.

The chemical injection line 230 is preferably a small-diameter, stainless steel tubing. The injection line 230 extends down into the wellbore 200 and terminates near the pump inlet. In this way, treating fluid is delivered proximate the reciprocating pump (not shown) below the anchor 900 to treat the downhole hardware.

The chemical injection line 230 is banded to joints of production tubing during run-in. Banding helps protect the chemical injection line 230.

Figure 2:
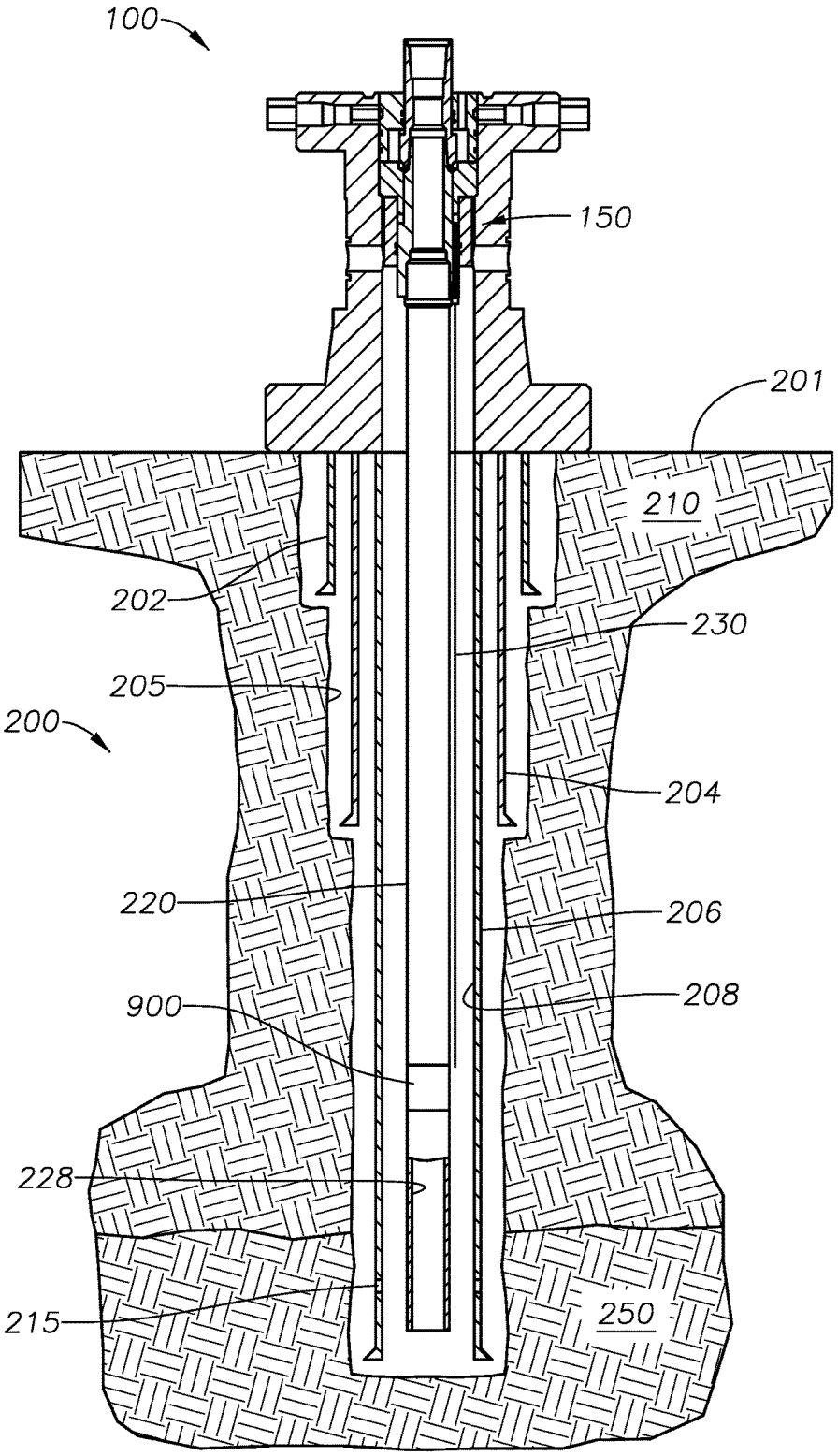
FIG. 2 is a cross-sectional view of an illustrative wellbore. The tubing head of FIG. 1 is provided over the wellbore at the surface while a tubing anchor is schematically shown downhole.

FIG. 2 is a cross-sectional view of an illustrative wellbore 200. The wellbore 200 defines a bore 205 that extends from a surface 201, and into the earth's subsurface 210. The wellbore 200 has been formed for the purpose of producing hydrocarbon fluids for commercial sale. A string of production tubing 220 is provided in the bore 205 to transport production fluids from a subsurface formation 250 up to the surface 201. In the illustrative arrangement of FIG. 2, the surface is a land surface.

The wellbore 200 includes a wellhead. Only the tubing head 100 (or "spool") of FIG. 1 is shown, along with the liner hanger 150 therein. However, it is understood that the wellhead will include a production valve that controls the flow of production fluids from the production tubing 220 to a flow line, and a back side valve that controls the flow of gases from the tubing-casing annulus 208 up to the flow line. In addition, a subsurface safety valve (not shown) is typically placed along the tubing string 220 below the surface 201 to block the flow of fluids from the subsurface formation 250 in the event of a rupture or catastrophic event at the surface 201 or otherwise above the subsurface safety valve.

The wellbore 200 will also have a pump (not shown) within or just above the subsurface formation 250. The pump may be either a reciprocating pump or a progressive cavity pump. The pump, of course, is used to artificially lift production fluids up to the tubing head 100. In the case of a reciprocating pump, the pump will be cycled up and down by means of a mechanical "pump jack" or by means of a hydraulic or pneumatic rod pumping system residing at the surface 201 over the wellbore 200.

An anchor is set at the lower end of the production tubing 220. The anchor prevents a corresponding axial movement of the pump barrel during reciprocation of the rod string. In the event a progressive cavity pump (or "PCP") is used, the rod string is used to rotate a rotor within a stator in the progressive cavity pump to pump hydrocarbon fluids to the surface.

In FIG. 2, the wellbore 200 has been completed by setting a series of pipes into the subsurface 210. These pipes include a first string of casing 202, sometimes known as surface casing. These pipes also include at least a second string of casing 204, and frequently a third string of casing (not shown). The casing string 204 is an intermediate casing string that provides support for walls of the wellbore 200. Intermediate casing strings may be hung from the surface 201, or they may be hung from a next higher casing string using an expandable liner or a liner hanger. It is understood that a pipe string that does not extend back to the surface is normally referred to as a "liner."

The wellbore 200 is completed with a final string of casing, known as production casing 206. The production casing 206 extends down to the subsurface formation 250. The casing string 206 includes perforations 215 which provide fluid communication between the bore 205 and the surrounding subsurface formation 250. In some instances, the final string of casing is a liner.

Each string of casing 202, 204, 206 is set in place through cement (not shown). The cement is "squeezed" into the annular regions around the respective casing strings, and serves to isolate the various formations of the subsurface 210 from the wellbore 200 and each other. In some instances, a production casing is not used and the subsurface formation is left "open." In this instance, a sand screen or a slotted liner may be used to filter fines and solids while permitting formation fluids to enter the wellbore 200.

The wellbore 200 further includes a string of production tubing 220. The production tubing 220 has a bore 228 that extends from the surface 201 down into the subterranean region 250. The production tubing 220 serves as a conduit for the production of reservoir fluids, such as hydrocarbon liquids. An annular region 208 is formed between the production tubing 220 and the surrounding tubular casing body 206.

It is observed that the present inventions are not limited to the type of casing arrangement used or the type of pump used. However, the inventions are beneficial for applying tension to the tubing string 220 while also accommodating a chemical injection line. Thus, FIG. 2 shows not only the tubing hanger 150, but also a tubing anchor 900 along the tubing string, and a chemical injection line 230.

Figure 3:
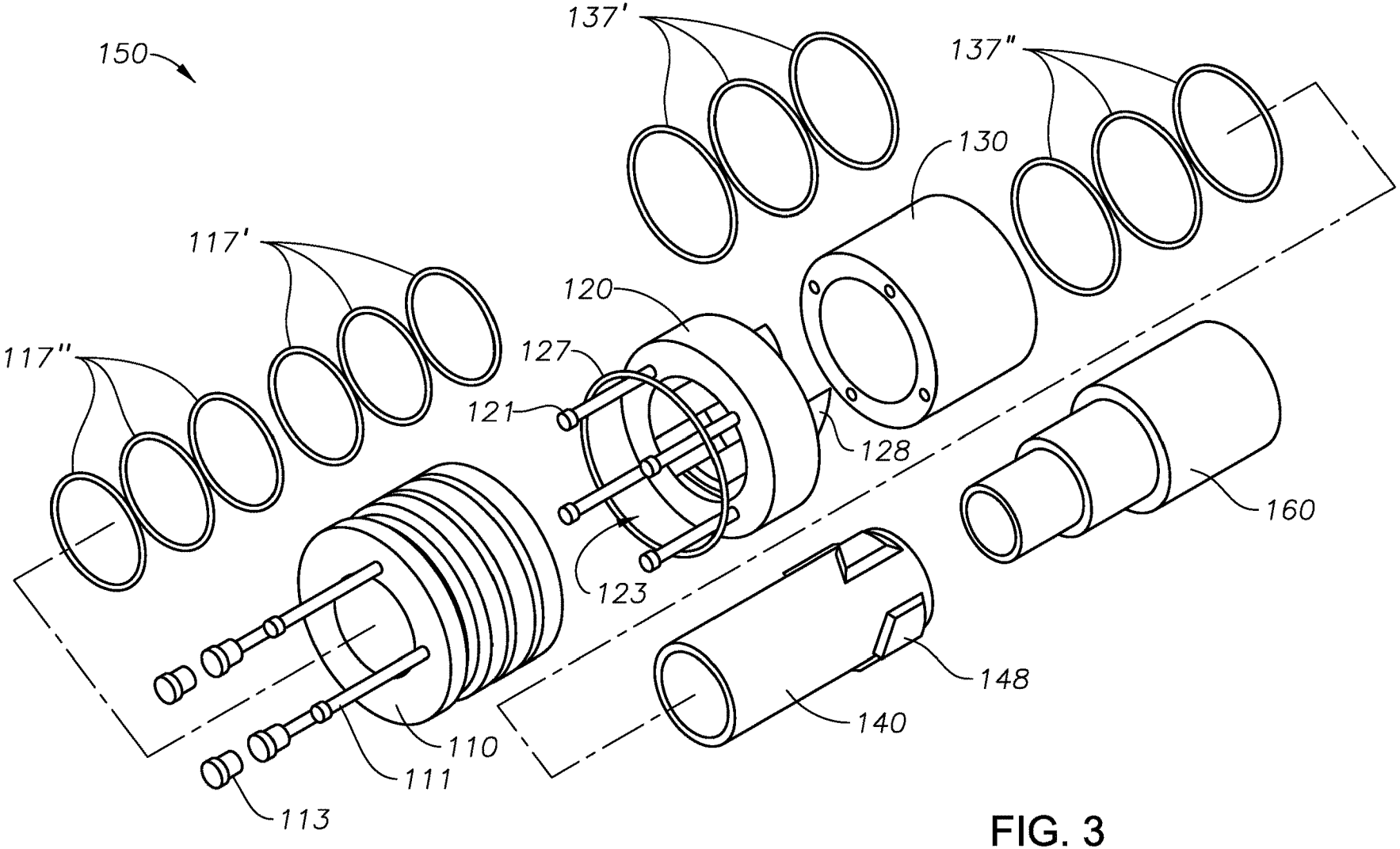
FIG. 3 is a perspective view of components of the tubing hanger of FIG. 1, in exploded-apart relation, in one embodiment.

FIG. 3 is a perspective view of components of the tubing hanger 150, in exploded-apart relation. Visible in this view are the interlocking top ring 110, the interlocking bottom ring 120, the chemical transfer ring 130, the top mandrel 140 and the bottom mandrel 160. The interlocking top ring 110, the interlocking bottom ring 120 and the chemical transfer ring 130 are secured together, along with appropriate o-rings, through bolts 111, 121. At the same time, the interlocking top ring 110, the interlocking bottom ring 120 and the chemical transfer ring 130 slidably receive the top 140 and bottom 160 mandrels. The top mandrel 140 includes a set of angled shoulders 148 along an outer diameter, shown more fully in FIG. 7C, which slide between fixed splines 128 of the interlocking bottom ring 120, seen more fully in FIG. 5B.

Figure 4A:
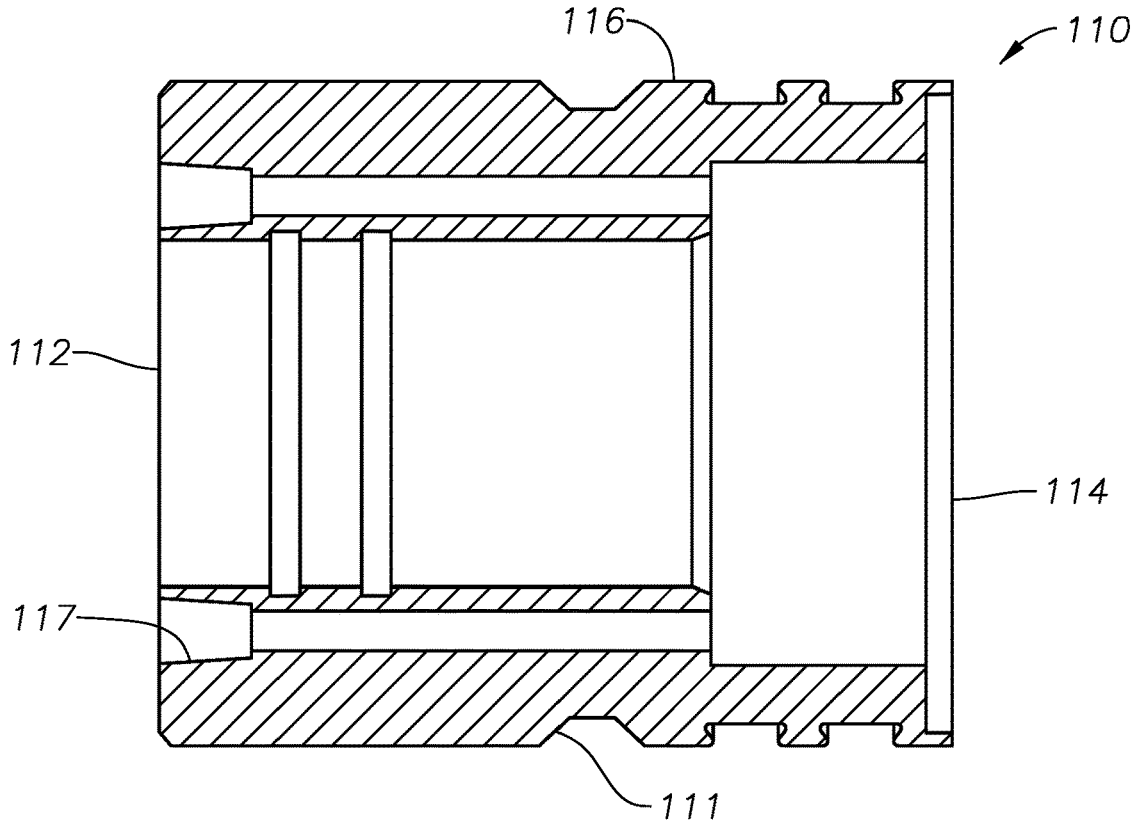
FIG. 4A is a cross-sectional view of the interlocking top ring of the tubing hanger of FIG. 3, in one embodiment.

FIG. 4A is a cross-sectional view of the interlocking top ring 110 of the tubing hanger 150 of FIG. 1, in one embodiment. The interlocking top ring 110 defines a short tubular body 116 having a proximal (or top) end 112 and a distal (or bottom) end 114. The generally cylindrical body 116 forms a bore 115 dimensioned to receive the proximal end 142 of the top mandrel 140.

Figure 4B:
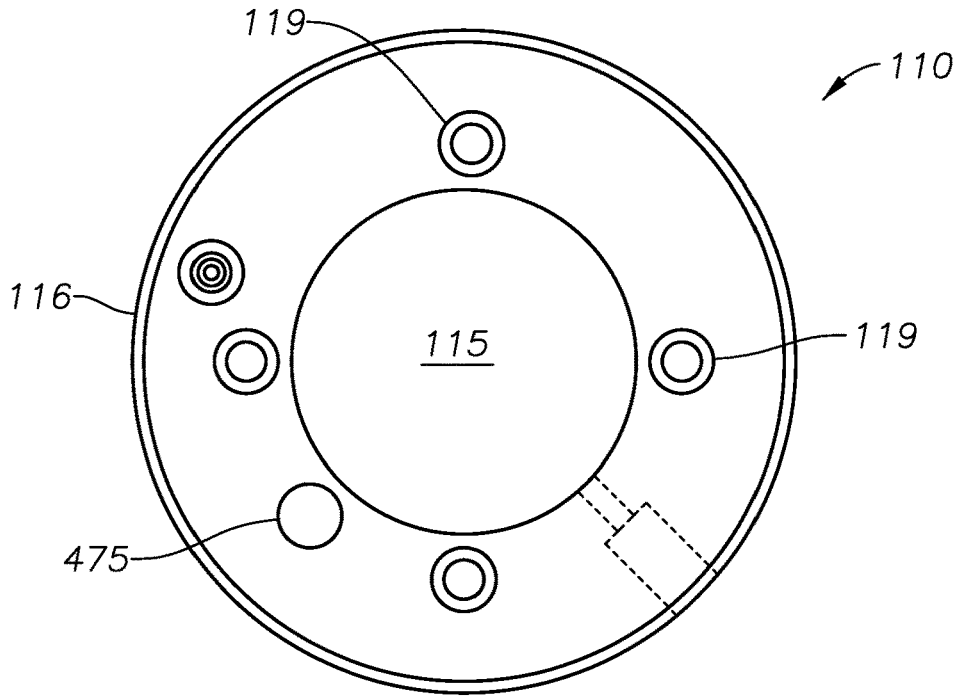
FIG. 4B is an end view of the interlocking top ring of FIG. 8A as viewed from a top or proximal end.

FIG. 4B is an end view of the interlocking top ring 110 of FIG. 8A as viewed from the proximal end 112. It is observed that four recesses 119 are provided equidistantly about the body 116 of the ring 110. These recesses 119 are dimensioned to receive bolts (seen at 111 in FIG. 3). The bolts 111 allow the interlocking top ring 110 to be secured to the interlocking bottom ring 120. Each bolt 111 is followed by an optional cap 113.

The interlocking top ring 110 is configured to reside within the bore 155 of the tubing head 100. Various seals or o-rings (seen in FIG. 3 at 117') may be placed about an outer diameter of the interlocking top ring 110. These help maintain a fluid seal between the interlocking top ring 110 and the surrounding bore 155. In addition, seals 117" (also seen in FIG. 3) may reside along the inner diameter of the body 116 to provide a fluid seal between the upper mandrel 140 and the surrounding interlocking top ring 110 upon assembly.

It is observed that the body 116 of the interlocking top ring 110 provides a small through-channel 475. The through-channel 475 runs the length of the body 116. Upon assembly, the through-channel 475 is aligned with conduit 175. The through-channel 475 serves as a conduit for passing the fluid chemical treatment from conduit 175 down to injection line 230.

The body 116 of the of the interlocking top ring 110 also includes a radial indentation, or reduced outer diameter portion 111. The reduced outer diameter portion 111 is configured to receive the opposing lock pins 180. When the lock pins 180 are screwed into the tubing head 100, they may be further tightened down onto the reduced outer diameter portion 111 to rotationally hold the interlocking top ring 110.

Figure 5A:
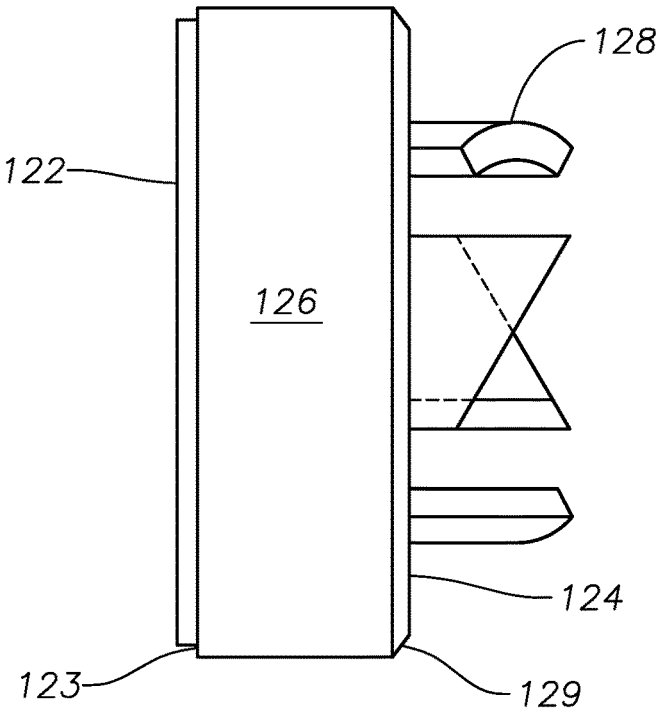
FIG. 5A is a side view of the interlocking bottom ring of the tubing hanger of FIG. 3, in one embodiment.

FIG. 5A is a side view of the interlocking bottom ring 120 of the tubing hanger 150 of FIG. 3, in one embodiment. The interlocking bottom ring 120 is also configured to reside within the bore 155 of the tubing head 100 just below the interlocking top ring 110. The interlocking bottom ring 120 also defines a short tubular body 126 having a proximal (or top) end 122 and a distal (or bottom) end 124. Extending from the distal end 124 are four splines 128. The splines 128 are spaced apart radially and equi-distantly and extend from the inner diameter of the body 126.

Figure 5B:
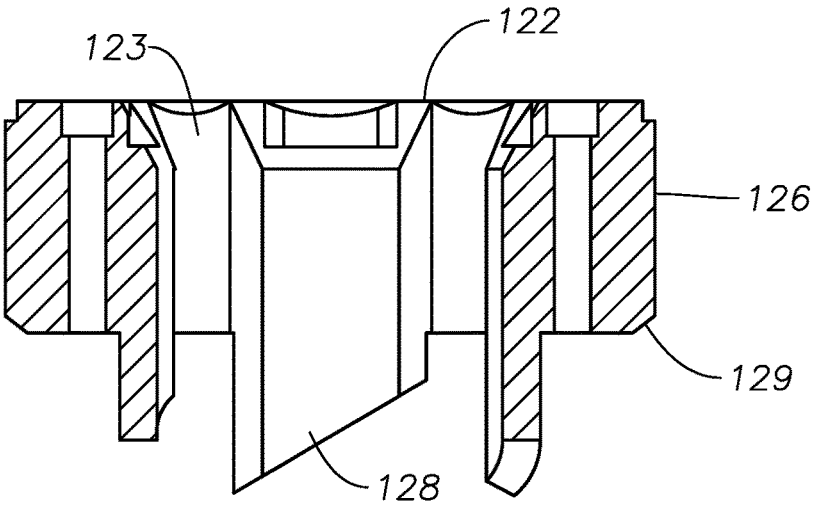
FIG. 5B is a cross-sectional view of the interlocking bottom ring of FIG. 6A.
Figure 5C:
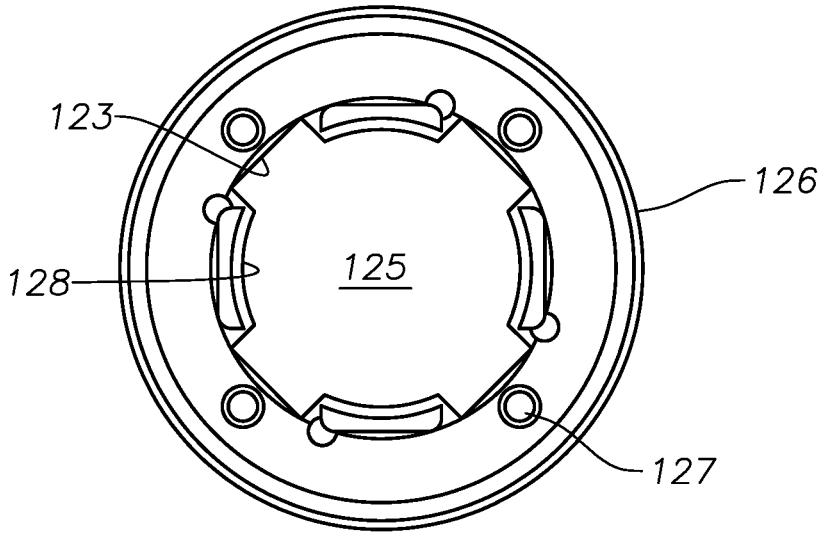
FIG. 5C is an end view of the interlocking bottom ring of FIG. 6A as viewed from a top or proximal end.

FIG. 5B is a cross-sectional view of the interlocking bottom ring 120 of FIG. 5A. FIG. 5C is an end view of the interlocking bottom ring 120 of FIG. 5A as viewed from the proximal end 122. A bore 125 (shown in FIG. 3) is formed within the body 126. The bore 125 is sized to receive the proximal end 142 of the top mandrel 160. In addition, spaces 123 reserved between the splines 128 are dimensioned to slidably receive the angled shoulders 148 of the top mandrel 140 when the mandrel assembly 140/160 is moved up and down within the tubular assembly 110/120/130.

FIG. 5C also shows a plurality of through-openings 127. The through-openings 127 receive bolts 121. FIG. 5C further shows the radial spacing of the splines 128 and the spaces 123 there between.

The distal end 124 of the body 126 comprises a beveled shoulder 129. The beveled shoulder 129 rests on a conical surface (seen at 102 in FIG. 1) within the tubing head 100, or "spool." In one embodiment, more o-rings are placed on a shoulder 123 at the proximate end 122 of the ring 120. This helps maintain a fluid seal between the bottom ring 120 and the surrounding tubing head 100.

In operation, the tubular assembly comprising the chemical injection ring 130, the interlocking bottom ring 120 and the interlocking top ring 110 are lowered into the tubing head 100 together. The beveled shoulder 129 of the bottom ring 120 lands on the matching conical shoulder 102 of the tubing head 100. Then, lock pins 180 are tightened down onto the interlocking top ring 110 to prevent rotation.

Next, the tubing anchor 900 is set (discussed below). The mandrel assembly (top mandrel 140 and bottom mandrel 160) and connected production tubing 220 are raised up and located along the interlocking bottom ring 120. With the angled shoulders 148 above the splines 128, the mandrel assembly 140/160 (and connected tubing string 220) is then rotated about a quarter turn, and the mandrel assembly 140/160 is dropped in order to lock the angled shoulders 148 onto the splines 128. This fixes the tubing string 220 (both longitudinally and rotationally) in tension.

Figure 6:
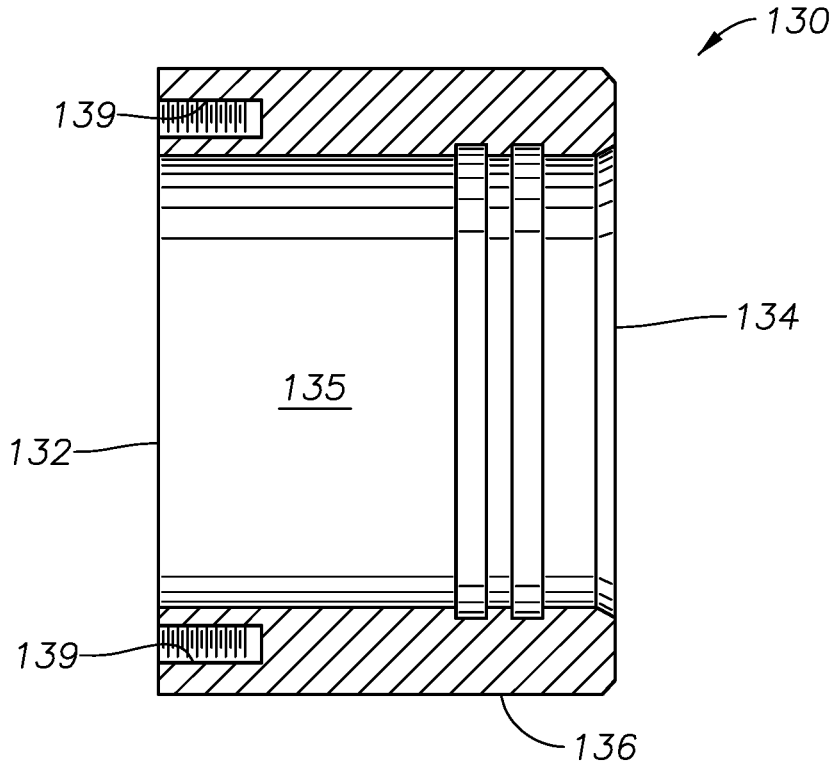
FIG. 6 is a cross-sectional view of the chemical transfer ring of the tubing hanger of FIG. 3, in one embodiment.

As noted, the tubing hanger 150 also includes a chemical transfer ring 130. FIG. 6 is a cross-sectional view of the chemical transfer ring 130 of the tubing hanger 150 of FIG. 3, in one embodiment. The chemical transfer ring 130 is configured to reside within the bore 155 of the tubing head 100 just below the bottom interlocking ring 120. The chemical transfer ring 130 defines a short tubular body 136 having a proximal (or top) end 132 and a distal (or bottom) end 134. The generally cylindrical body 136 forms a bore 135 that is dimensioned to receive the proximal end 142 of the top mandrel 140.

It is also noted that recesses 139 are formed along the body 136 at the proximal end 132. The recesses 139 are threaded and are dimensioned to receive bolts (shown at 121 in FIG. 3). This secures the interlocking bottom ring 120 to the chemical transfer ring 130.

Also of interest, the illustrative chemical transfer ring 130 has two or more o-rings (seen at 137 in FIG. 3). These are actually installed along the outer diameter of the body 136 to provide a fluid seal between the chemical transfer ring 130 and adjacent hardware assembly. Separate o-rings 137" may be used to provide a seal between the bottom mandrel 160 and the surrounding chemical transfer ring 130.

The interlocking top ring 110, the interlocking bottom ring 120 and the chemical transfer ring 130 together form a tubular assembly. The tubular assembly resides along the inner diameter (or bore 155) of the tubing head 100. Preferably, the tubular assembly 110/120/130 is installed when the last (or uppermost) joint of production tubing 220 has been run into the wellbore 200, and before the top 140 and bottom 160 mandrels are connected. The conical beveled shoulder 129 of the interlocking bottom ring 120 is landed on the conical surface 102 within the tubing head 100.

Figure 7A:
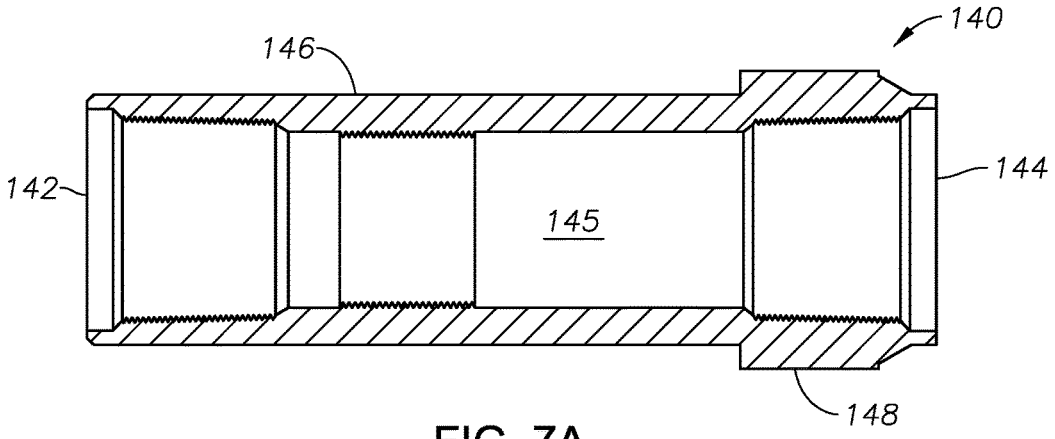
FIG. 7A is a cross-sectional view of the top mandrel of the tubing hanger of FIG. 3, in one embodiment.

FIG. 7A is a cross-sectional view of the top mandrel 140 of the tubing hanger 150 of FIG. 3, in one embodiment. The top mandrel 140 also defines a generally tubular body 146 having a proximal end 142 and a distal end 144. A bore 145 is formed within the body 146 which is sized to receive the proximal end 162 of the bottom mandrel 160.

Figure 7B:
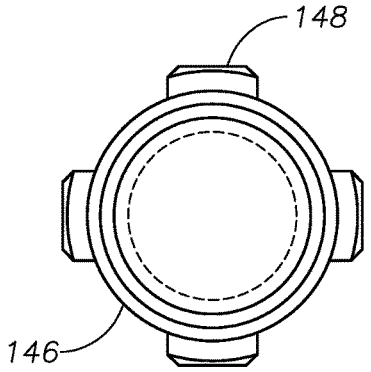
FIG. 7B is an end view of the top mandrel of FIG. 5A as viewed from the top, or proximal end.
Figure 7C:
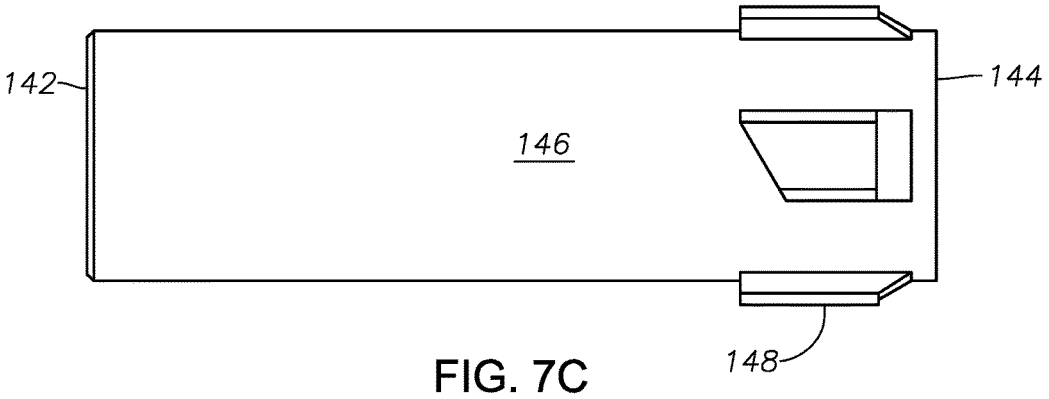
FIG. 7C is a side view of the top mandrel of FIG. 5A.

FIG. 7B is an end view of the top mandrel 140 of FIG. 5A as viewed from the top, or proximal end 142. FIG. 7C is a side view of the top mandrel 140 of FIG. 5A. Visible here are angled shoulders 148. In the arrangement of FIGS. 7A, 7B and 7C, four separate angled shoulders 148 are spaced radially and equi-distantly apart.

Figure 8:
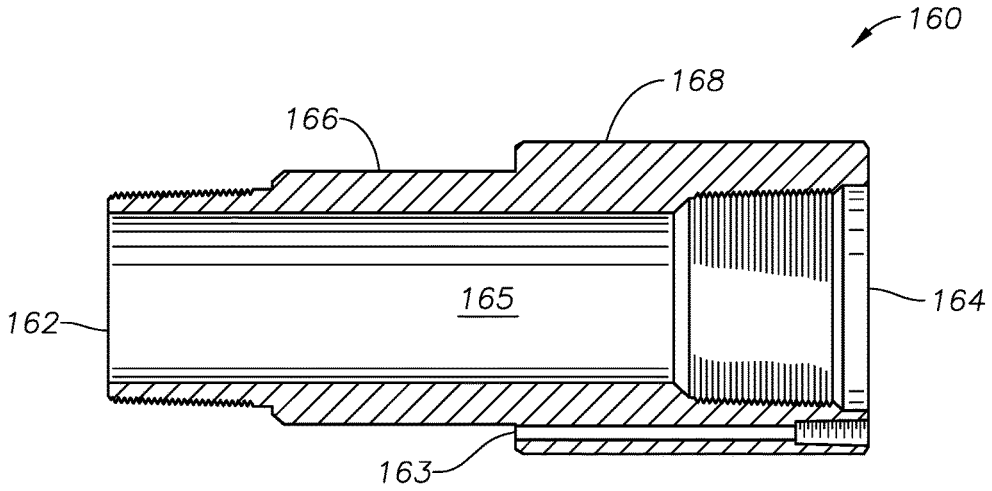
FIG. 8 is a cross-sectional view of the bottom mandrel of the tubing hanger of FIG. 3, in one embodiment. A channel for communicating a chemical treatment fluid is seen along the body.

FIG. 8 is a cross-sectional view of the bottom mandrel 160 of the tubing hanger 150 of FIG. 3, in one embodiment. The bottom mandrel 160 defines a generally tubular body 166 having a proximal end 162 and a distal end 164. A bore 165 is formed within the body 166 which transports production fluids through the tubing head 100.

During well completion, the proximal end 162 of the bottom mandrel 160 is threadedly connected to the distal end 144 of the top mandrel 140 using a 2⅞" EUE 8 round thread. The distal end 164 of the bottom mandrel 160 defines female threads that connect with the pin end of the uppermost joint of production tubing 220. Once the connection with the string of production tubing 220 is made, the top mandrel 140 and the bottom mandrel 160 are lowered in the wellhead 100 together until the tubing anchor 900 is at a desired depth within the production casing 206. The entire tubing hanger 150 is now in place.

Figure 9:
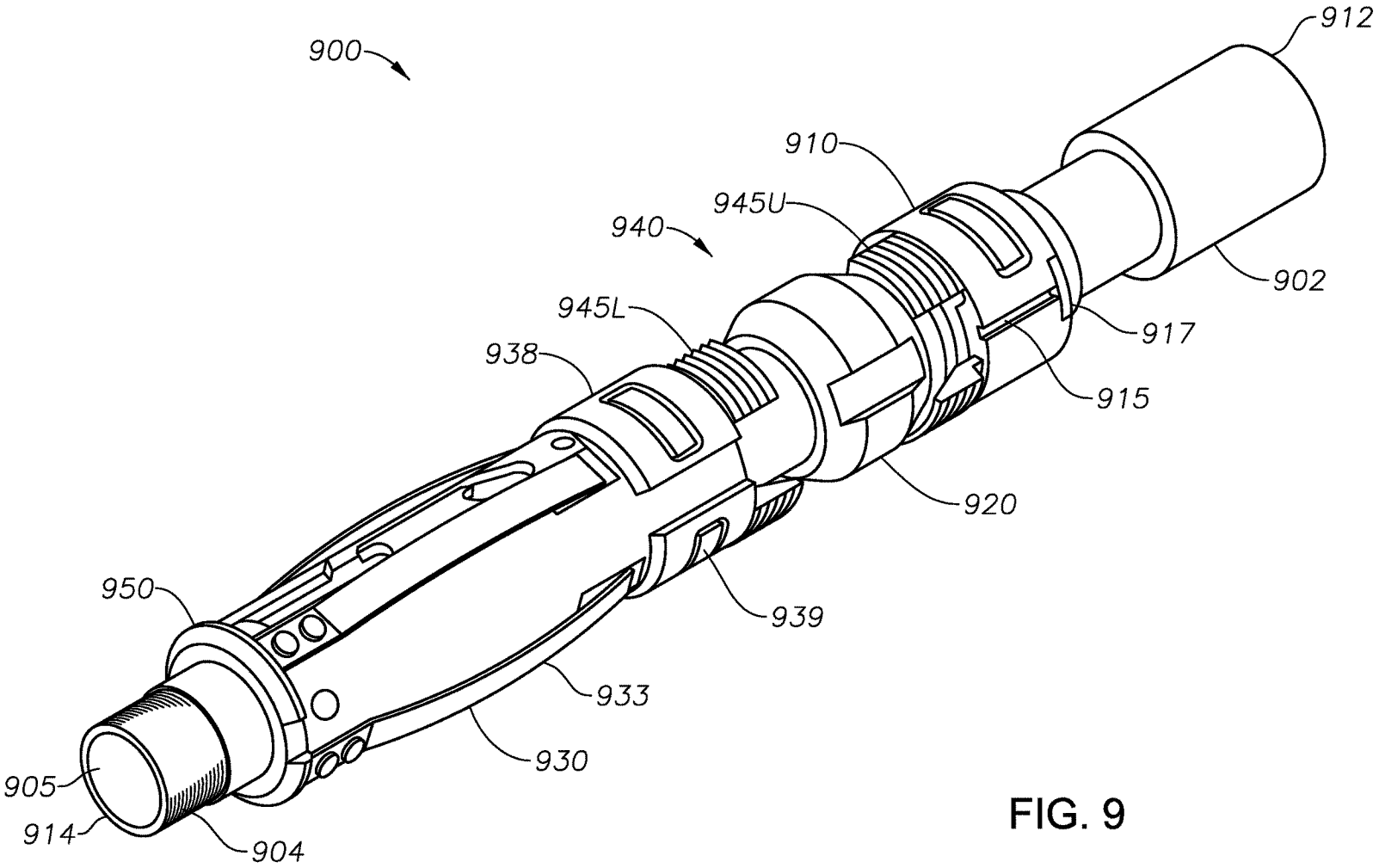
FIG. 9 is a perspective view of a tubing anchor as may be used in connection with the tubing hanger system of the present invention, in one embodiment.

It is again observed that the top mandrel 140 and the bottom mandrel 160 together form a mandrel assembly. The dimensions of the top 140 and bottom 160 mandrels may be changed to accommodate the size of the tubing head 100 and the tubular assembly As noted, the tubing hanger system also includes a tubing anchor 900. FIG. 9 is an enlarged perspective view of a tubing anchor 900 as may be used in connection with the tubing hanger system of the present invention, in one embodiment. FIG. 9 demonstrates that the tubing anchor 900 is made up of several components. These include an upper female box connector 902, an upper slip body 910, a cone 920, a J-lock control body 930 (with an integral lower slip body 938), slips 940, a threaded stop member 950 and a lower pin connector 904. In the view of FIG. 9, the slips 940 have not been actuated and the tubing anchor 900 has not been set in the surrounding casing 220.

It is observed that the tubing anchor 900 defines a generally tubular body having a proximal end 912 and a distal end 914. A bore 905 is provided along the length of the tubing anchor 900. This allows production fluids to flow up the production tubing 220 and to the tubing head 100 at the surface 201.

The upper tubing connector 902 resides at the proximal, or top end 912. The tubing connector 902 provides a female "box" connection that receives a male "pin end" of a jointed tubing 220. In one aspect, the female connection has a 2⅞" outer diameter and 2½" ACME threads along the inner diameter.

The tubing anchor 900 is intended to be run into the wellbore 200 near the bottom of the tubing string 220. Below the tubing anchor 900, perhaps less than 100 feet, is a downhole pump (not shown). The pump, or at least the standing valve portion, is installed along the tubing string 220 using, for example, a tap-type puller having an anvil.

In practice, a first joint of tubing string 220 is lowered into the well 205 while keeping the proximal (or top) end 902 of the tubing anchor 900 still at the surface 201. Another section of pipe is connected to the tubing connector 902. From that point, a check valve (not shown) connected to the ¼" chemical injection line 230 is banded to the joint of pipe. The check valve prevents chemical treatment fluid and wellbore fluids from running up the chemical injection line 230.

As joints of pipe 220 are added and depth increases, banding of the ¼' line 230 continues. Once the desired depth is achieved for setting the tubing anchor 900, the tubular assembly 110/120/130 of the tubing hanger 150 is placed inside of the tubing spool 100 at the surface 201. Next, the mandrel assembly (top mandrel 140 and bottom mandrel 160) of the tubing hanger 150 is connected to the string of pipe 220 and is lowered towards the tubing head 100. Preferably, a tubular landing sub (not shown) is connected to the proximal (or top) end 142 of the top mandrel 140. The tubing string 220 is then further lowered to a position where the tubing anchor 900 is to be set in the production casing 106.

It is again observed here that the bottom mandrel 160 threads into the top mandrel 140 with a 2⅞" EUE 8 round thread. Threads are shown in FIG. 8. The threaded connection ensures that the bottom mandrel 160 is connected to the top mandrel 140 so that they move together as a mandrel assembly.

The top mandrel 140 is landed on the interlocking bottom ring 120. The conical beveled shoulder 129 of the interlocking bottom ring 120 rests on the conical surface 102 within the tubing head 100. The production tubing 220 is now gravitationally hanging in tension due to the weight of the tubing string 220. The lock pins 180 from the tubing head 100, or "spool," are then rotated to engage with the cylindrical interlocking top ring 110. Specifically, the lock pins 180 tighten down into the recessed outer diameter portion 111.

The top mandrel 140 may be turned into and out of its locked position. When the top mandrel 140 is out of its locked position, it can freely float within the well bore 205. In this unlocked position, the angled shoulders 148 slide vertically through the spaces 123 between the splines 128 of the interlocking bottom ring 120. The tubing string 220 is then lowered and comes to a position where the tubing anchor 900 will be set.

The tubing anchor 900 also includes slips 940. The slips 940 define a set of opposing slip segments representing upper 945U and lower 945L segments. Actuation of the slips 940 causes the tubing anchor 900 to be set in the production casing 106.

The tubing anchor 900 also comprises upper and lower slip bodies. The upper slip body is an independent tubular body shown at 910 in FIGS. 9 and 13. The lower slip body is integral to the J-lock control body 930 and is shown at 938 in FIGS. 9 and 11B.

A slot 911 in the upper slip body 910 (seen in FIG. 13) locks into or receives an upper slip segment 945U. The upper 945U and lower 945L slip segments ride upon respective upper and lower slip sleeves (not seen) when actuated at the point of setting.

Of interest, and as discussed further below in connection with FIG. 13, a groove 915 resides along the upper slip body 910. The groove 915 is dimensioned to receive a distal end of the chemical injection line 230. A keeper tab 917 snaps over the chemical injection line 230 to help hold the line 230 in place. The keeper tab 917 is secured onto the recess 919 by screws.

The groove arrangement 915 allows the chemical injection line 230 to reside within the wellbore 200 without being damaged during run-in and without interfering with operation of the anchor 900 during setting. This unique arrangement enables a downhole pump and other downhole hardware to receive inhibitors that prevent build-up of paraffin, wax and corrosive elements that can lead to failure.

It is observed that the chemical injection line 230 need not terminate at the tubing anchor/catcher 900, but may continue on past the anchor 900 to the pump inlet.

Figure 10A:
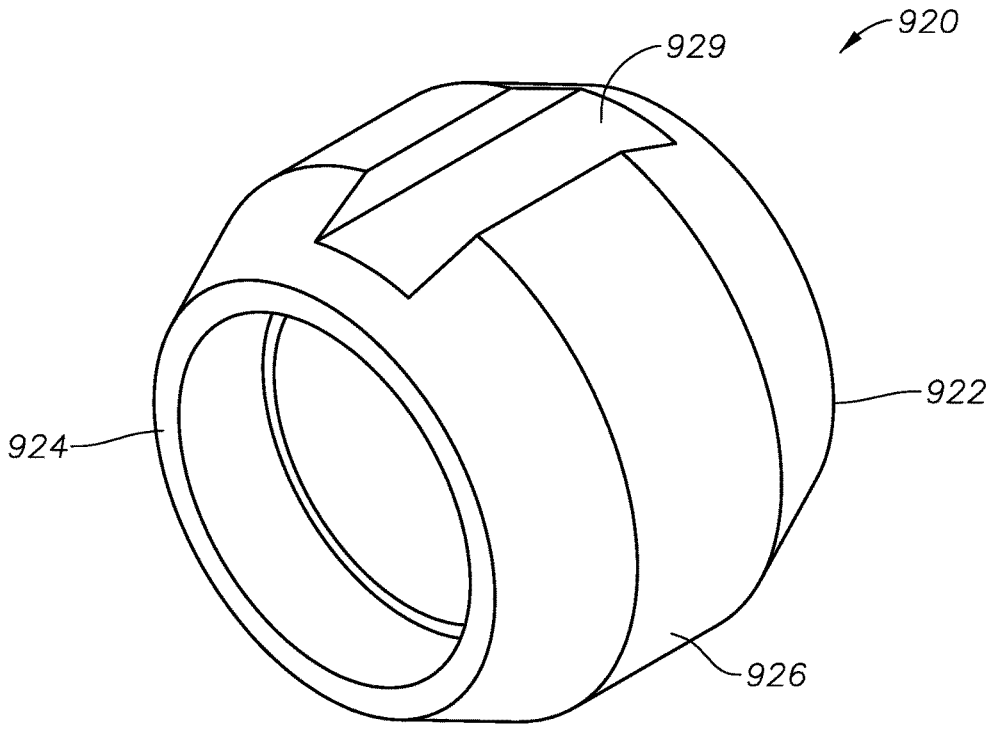
FIG. 10A is a perspective view of the cone of the tubing anchor of FIG. 9, in one embodiment.

Around the slips 940 is a cone 920. FIG. 10A is a perspective view of the cone 920 of the tubing anchor 900 of FIG. 9, in one embodiment. As can be seen, the cone 920 defines a generally tubular member having a proximal end 922 and a distal end 924. The cone 920 comprises a body 926 that has a groove 929 running substantially the length thereof. The groove 929 is configured to receive the chemical injection line 230 below the channel 915. Upon assembly of the tubing anchor 900, groove 929 aligns with groove 915.

Figure 10B:
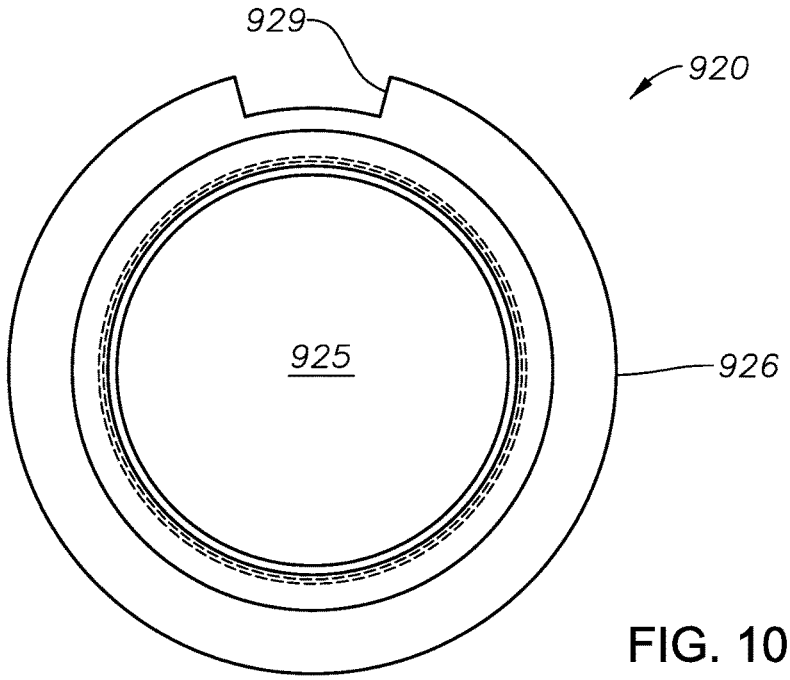
FIG. 10B is an end view of the cone of FIG. 10A as viewed from a bottom or distal end.

FIG. 10B is an end view of the cone 940 of FIG. 10A as viewed from the bottom or distal end 924. The profile of the groove 929 is more clearly seen. Also visible is a bore 925 formed by the body 926. In practice, the cone 920 threadedly connects opposing slip segments 945 of the slips 940 while providing a means of traverse for the chemical injection line 230.

Figure 11A:
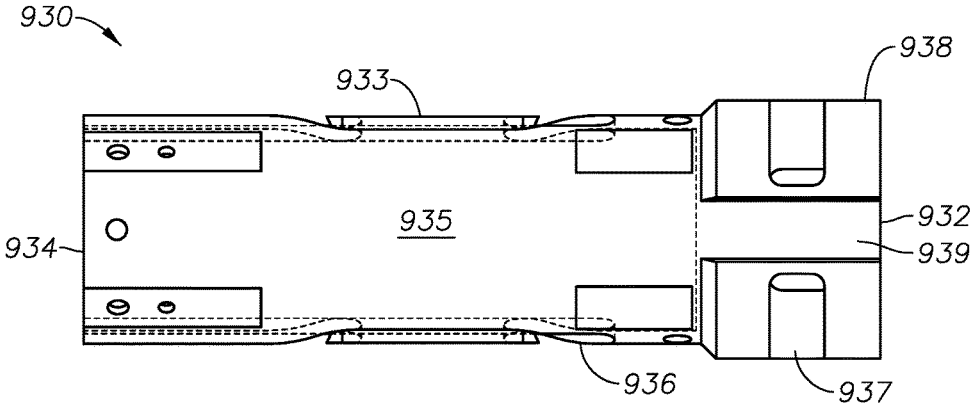
FIG. 11A is a cross-sectional view of a J-lock control body of the tubing anchor of FIG. 9, in one embodiment.
Figure 11B:
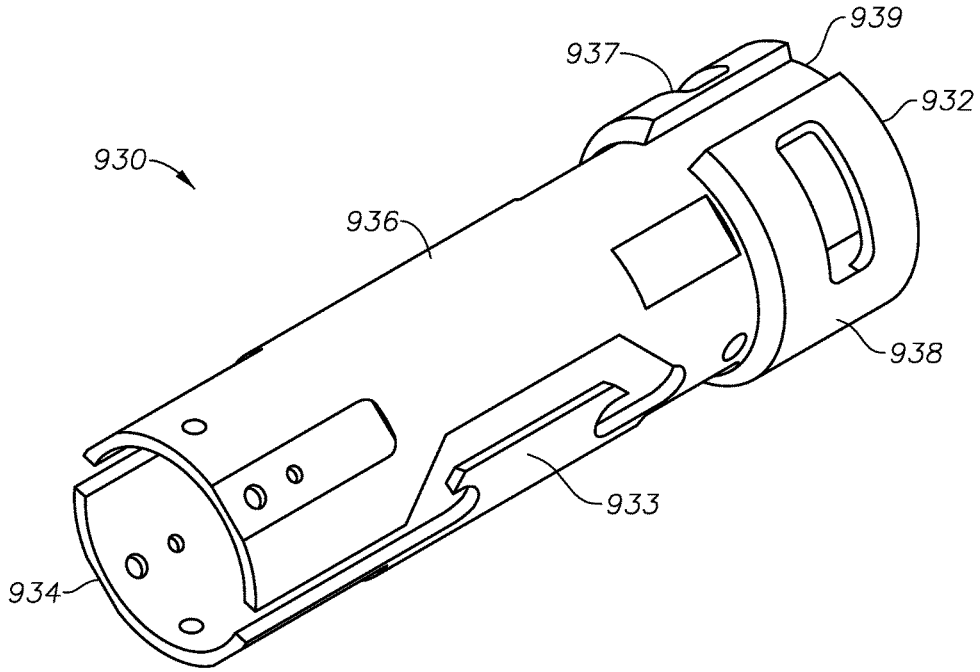
FIG. 11B is a perspective view of the J-lock control body of FIG. 11A.

FIG. 11A is a cross-sectional view of the J-lock control body 930 of the tubing anchor 900 of FIG. 9, in one embodiment. FIG. 11B is a perspective view of the control body 930 of FIG. 11A. The J-lock control body 930 will be discussed with reference to each of these figures together.

The J-lock control body 930 is a generally tubular wall 936 having a proximal end 932 and a distal end 934. A channel 939 is preserved along the shoulder to accommodate the chemical injection line 230. In addition, a bore 935 is formed within the wall 936 for the transport of production fluids en route to the surface 201.

The proximal end 932 comprises the lower slip body 938. The slip body 938 has radially disposed slots 937. The slots 937 latch into the lower slip segment 945L. In addition, the wall 936 of the control body 930 includes opposing J-lock profiles 933. Action of a pin (not shown) along the J-lock profiles 933 allows the operator to actuate the slip segments 945 into biting engagement with the surrounding casing string 206.

It is noted that the J-Lock control body 930 is a modified version of a known tubing anchor/catcher. The known tubing anchor catcher will have certain components not seen in FIGS. 11A and 11B but which are understood by those of ordinary skill in the art to be present. Such features may include a J-pin ring residing along the J-lock control body 930, a bottom sleeve, and one or more shear pins. U.S. Pat. No. 4,605,063 entitled "Chemical Injection Tubing Anchor-Catcher" is referred to and incorporated by reference in its entirety herein. The '063 describes the setting of a rotationally-set anchor-catcher.

During run-in, the J-pin ring is attached to a bottom sleeve (not shown) by shear pins. The shear pins temporarily fix the bottom sleeve along the body 936. Shearing of the pins allows the bottom sleeve to slide out of a landing position and to start actuation of the slip segments 945. It is noted though that the pins are only sheared when pulling up on the tubing, causing the slips to release. Turn to the right will not release the slips.

During setting of the tubing anchor 900, the tubing string 220 with connected anchor 900 is turned clockwise. This positions the J-pin ring into a diagonal portion of the J-slot 933. The string 220 is then lowered the distance of the J-slot 933. A lower slip sleeve (not visible) is connected to the lower slip body 938, which houses the two slips (upper 945U and lower 945L slip segments). A releasing slip is provided in both the upper 945U and the lower 945L slip segments, where each has three segments in which two hold and one releases. Both the lower slip sleeve and the lower slip body 938 begin sliding on the outside diameter of the tubing anchor body 936. Once engaged by the top sub connected to the proximal end 932, the lower slip body 938 begins a downward descent relative to the wellbore 200. The upper slip segment 945U and upper slip body 938 come into contact with a notch that is on the tubing anchor body 936. This action pins the sleeve and the lower slip body 938 between the notch and the top sub.

The sleeve and the lower slip body 938 now come into contact with the cone 920. The cone 920 is connected to the lower slip segment 945L. With the string 220 still moving downward, the cone 920 that is now in contact with the lower slips 945L force the cone 920 and lower slips 945L to come in contact with the slips 945 that are being housed in the upper end 932 of the J-Lock control body 930. Setting of the slips 945 is caused by pulling up on the anchor body, which causes the springs 933 to drag along the tubing to be turned to the left ⅛ (45°) turn. This action causes the slips 945U, 945L in the J-Lock control body 930 to grip the casing internal diameter. As the J-Pin approaches the end of the J-slot 933, the string 220 makes a counter-clockwise turn to prepare to set. Once the J-Pin is in position, the string 220 is pulled back up slightly to set the anchor 900 in place.

It is observed that the tubing anchor 900 is uniquely configured to lock into the casing slips 945 using only the a ⅛ (45°) turn. In contrast, known tubing anchors use several turns to lock and set. Tubing anchors that need several turns to set can result in entanglement of any chemical tubing lines, causing them to bend and break. Further, some tubing anchors are set through use of the pressure of the chemicals or hydraulic pressure in the ¼" line, which actuates the slips. The draw back to chemical or hydraulic pressure is that the tubing anchor may not hold tightly in the casing. Also, splices that connect the main line together in order for the tubing anchor to actuate often fail to hold pressure, and leak. In contrast, the present tubing anchor design 900 does not require such splices; instead, the present tubing anchor 900 is actuated merely by pulling back up on the tubing string 220, allowing drag of the springs 933 to pull the control body 930 and shear pins, followed by the ⅛$^{th}$ turn clockwise.

Figure 12B:
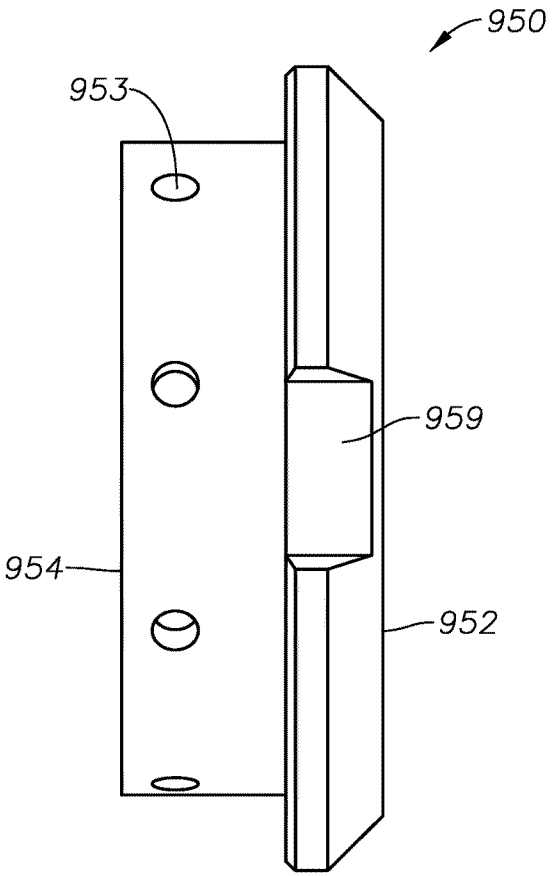
FIG. 12B is a side view of the control body ring of FIG. 12A.
Figure 12A:
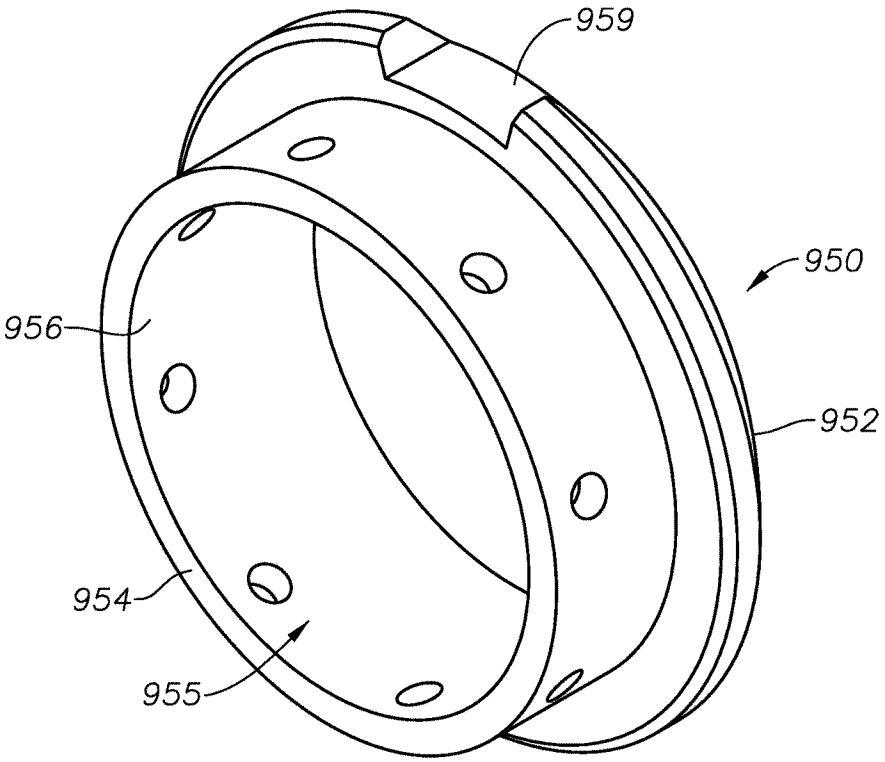
FIG. 12A is a perspective view of the control body ring of the tubing anchor of FIG. 9.
Figure 12C:
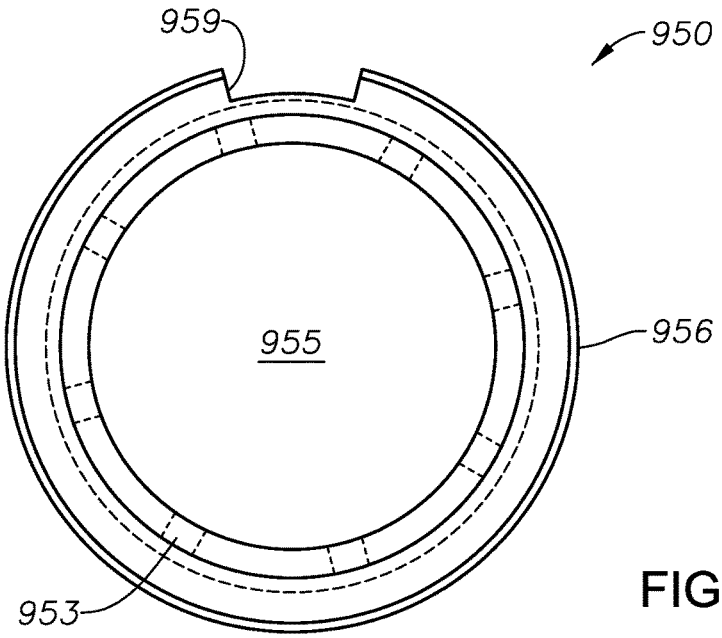
FIG. 12C is an end view of the control body ring of FIG. 12A as viewed from a top or proximal end.

FIG. 12A is a perspective view of the J-control body ring 950 of the tubing anchor 900 of FIG. 9. FIG. 12B is a side view of the control body ring 950 of FIG. 12A. FIG. 12C is an end view of the control body ring of FIG. 12A as viewed from the top or proximal end 952. The J-control body ring 950 will be discussed with reference to each of these three figures.

The J-control body ring 950 comprises a generally circular body 956 having a proximal end 952 and a distal end 954. The ring 950 serves as a "no-go" gauge that keeps the anchor 900 from being lowered into crushed casing. A short bore 955 is formed there through. The distal end 954 is flanged, with the flange preserving a channel 959 to receive the chemical injection line 230.

A plurality of holes 953 are formed radially through the body 956. The holes 953 reside equi-distantly about the body 956. The holes 953 are dimensioned to receive bolts (not shown) that secure the body 956 to the body 936 of the J-lock control body 930.

Figure 13:
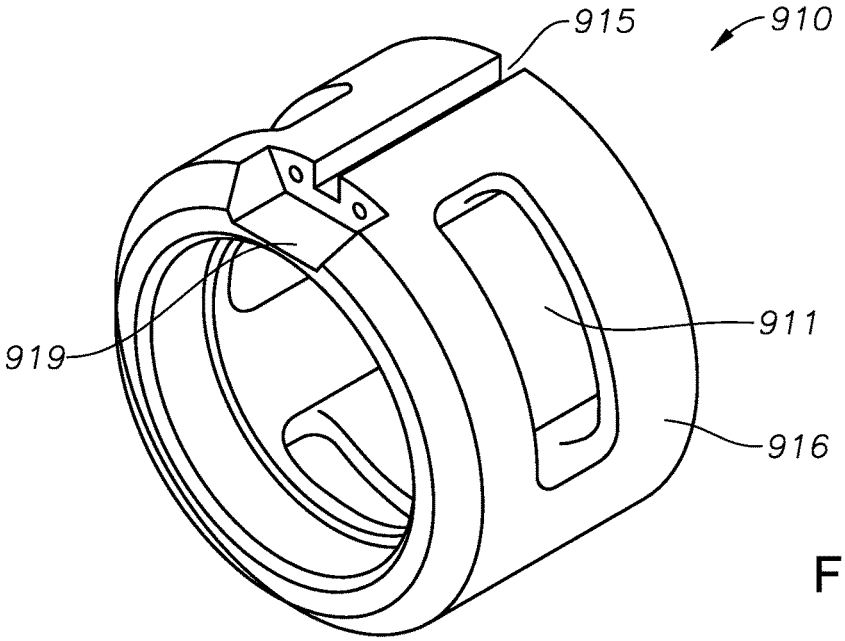
FIG. 13 is a perspective view of a lower slip body as used in the tubing anchor of FIG. 9, in one embodiment.

Finally, FIG. 13 is a perspective view of the upper slip body 910. The upper slip body 910 comprises a generally tubular body 956. The upper slip body 910 includes a slot 911 that receives a portion of the upper slip segment 945U. The upper slip body 910 also includes channel 915. The channel 915 is dimensioned to accommodate the chemical injection line 230. It is also seen that a recess is milled out and two holes are drill and tapped for a machined tab 917 to fit, which is held down by screws (not shown).

As can be seen, an improved tubing hanger assembly is provided. The tubing hanger assembly includes a tubing hanger 150 and a tubing anchor 900, each of which is set in a wellbore using less than a full rotation, and in a preferred embodiment, less than a 180° rotation.

Using the tubing hanger assembly 150/900, a method for hanging a string of production tubing in a wellbore is also provided herein. The method employs the tubing hanger system as described above, in any of its various embodiments.

The method first includes providing a tubing hanger system. The tubing hanger system includes the tubing hanger and the tubing anchor, wherein the tubing hanger and the tubing anchor are each configured to be set through a rotation that is less than one full rotation.

The method also includes threadedly connecting a joint of production tubing to the tubing anchor. The method then includes running a string of production tubing into the wellbore, joint-by-joint, wherein the tubing anchor is threadedly connected to the production tubing proximate a lower end of the production tubing.

The method additionally includes threadedly connecting the tubing hanger to the string of production tubing at an upper end of the production tubing. The method then includes lowering the tubing hanger so as to position the tubing anchor at a desired depth downhole.

The method further comprises setting the tubing anchor within a string of surrounding production casing within the wellbore. The method then includes applying tension to the tubing string. Applying tension to the tubing string means pulling on the production tubing from the surface.

In accordance with embodiments of the invention, the method additionally comprises setting the tubing hanger within a tubing head at a surface above the wellbore. This first comprises landing a tubular assembly within the bore of a tubing head forming a portion of the wellhead. The tubing hanger has a beveled shoulder along the outer diameter which is configured to land on a matching conical surface machined along the tubing head. This also includes threadedly connecting a mandrel assembly to the upper end of the production tubing.

The method further comprises banding a chemical injection line 230 to the production tubing 220, joint-by-joint, during run-in. An upper end of the injection line 230 is connected to a lower end of the bottom mandrel 160, such as through use of a compression fitting 172. In this way, a channel within the interlocking top ring 110 and the bottom mandrel 160 are in sealed fluid communication with the injection line 230. The chemical injection line 230 extends downhole from the fitting 172 to the tubing anchor 900. In this way, a chemical treatment fluid may be injected into the channel and then into the chemical injection line 230, where it is transmitted downhole to the tubing anchor 900.

In operation, the mandrel assembly (top mandrel 140 and bottom mandrel 160) of the tubing hanger 150 is lowered into the bore 205 in order to set the tubing anchor 900. Material for the hanger 150 is determined by the well conditions. After the tubing anchor 900 is set, the mandrel assembly (top mandrel 140 and bottom mandrel 160) and connected tubing string 220 are raised back up to pass through the bore 135 of the chemical transfer ring 130 and the bore 125 of the interlocking bottom ring 120. This involves moving the angled shoulders 148 of the top mandrel 140 up through the spaces 123 between the splines 128 until the mandrel assembly 140/160 comes to a stop within the interlocking top ring 110. The angled shoulders 148 have now cleared the splines 128 and the string of production tubing 220 in tension.

The mandrel assembly (top mandrel 140 and bottom mandrel 160) is then rotated ¼ turn clockwise relative to the bore 115 while the angled shoulders 148 are above the splines 128. The method then includes lowering the mandrel assembly 140/160 back down along the tubular assembly 110/12/130 in order to lock the tubing hanger within the surrounding production casing. This prevents further rotational and longitudinal movement of the mandrel assembly 140/160 within the wellbore 200.

Beneficially, the tubing hanger is set by pulling tension on the production tubing 220 and the connected chemical injection line 230 without undue torsional stress. Chemicals can now be supplied to the wellbore 205 through the injection conduit 175. Chemicals are then flushed through the splines 128 of the interlocking bottom ring 120. The chemical injection tubing 230 preferably terminates proximate a downhole pump below the tubing anchor within the wellbore.

In one embodiment of the method, an adapter is placed above the tubing hanger. More specifically, an adapter is threadedly connected to the top mandrel 140. A pocket is provided at the bottom of the adapter that is configured to receive the top mandrel 140 and seals the well.

At the upper end, the adapter provides a connection for a valve, a pumping tee or other hardware that is part of the well head. This top connection can be either threaded or studded with a ring groove.

The adapter includes a first port that allows for the injection of the chemical treatment fluid into the tubing hanger. This first port provides fluid access to the channel 175 in the interlocking top ring 110 and down to the channel 163 in the bottom mandrel 160. The adapter also includes second and third ports that enable testing of the seals on both the chemical channels 175, 163 and the tubing hanger body.

The adapter is an optional feature. It typically is not needed with low producing wells where the operator produces from the top connection of the tubing hanger. In any event, the method then includes producing hydrocarbon fluids to the tubing hanger at the surface, through the production tubing 220.

As can be seen, a tubing hanger system is provided that includes both a novel tubing hanger 150 and a novel tubing anchor 900. The tubing hanger system provides an assembly of engineered parts that enable a method of pulling tension in the tubing string 220 from the surface 201, and then holding that tension by means of a locking design. Once in the locking position, chemicals (such as corrosion inhibitors) can be pumped through the tubing hanger 150 and down an injection line 230. In one aspect, the system is able to hold tension without use of shear pins and springs, saving considerable manufacturing costs.

Another advantage of the tubing hanger system presented herein is the ability to transfer downward force created from the gravitational force on the tubing string 220, and lock the top mandrel body 140 within the tubing head 100. This, in turn, prevents further rotation about the longitudinal axis of the casing strings 202, 204, 206 within the wellbore 200.

Still another advantage of the tension hanger system is in the method of delivering chemicals that treat the pump or that treat the formation. Such chemicals may include steam, corrosion inhibitors, foam and water. Chemicals are able to be delivered downhole under minimal pressure while the tubing hanger is in its locked position and while maintaining a seal within the tubing hanger itself. Further, a seal is maintained within the casing spool where the tubing hanger suspends from the tubing head.

While it will be apparent that the inventions herein described are well calculated to achieve the benefits and advantages set forth above, it will be appreciated that the inventions are susceptible to modification, variation and change without departing from the spirit thereof.

What is claimed is:

1. A tubing hanger system for suspending a production tubing string within a wellbore, comprising:

a tubing hanger threadedly connectable to the tubing string at an upper end of the tubing string, and configured to reside within a tubing head over the wellbore and to gravitationally support the tubing string in tension;

a tubing anchor threadedly connectable to the tubing string proximate a lower end of the tubing string, and configured to be set within a string of production casing downhole; and at least one channel located along an outer diameter of the tubing anchor, said at least one channel adapted for receiving a chemical injection line therethrough, wherein:

the tubing hanger comprises a tubular assembly having an inner diameter and an outer diameter, with a shoulder along the outer diameter dimensioned to land on an inner surface of the tubing head;

the tubing hanger and the tubing anchor are each configured to be set in the wellbore through a rotation of the tubing string that is less than one full rotation;

the tubing hanger further comprises:

a series of radially spaced apart splines extending from the inner diameter of the tubular assembly of the tubing hanger; and a mandrel assembly defining a tubular body configured to be slidably received within a bore of the tubular assembly of the tubing hanger, the mandrel assembly comprising:

an upper end;

a threaded lower end configured to be threadedly connected to the upper end of the tubing string; and a plurality of shoulders spaced radially around an outer diameter of the mandrel assembly, said shoulders configured to pass between the splines of the tubular assembly of the tubing hanger when the mandrel assembly is moved axially in the bore of the tubular assembly, wherein the plurality of shoulders are configured such that, when the mandrel assembly is moved axially upward within the bore of the tubular assembly of the tubing hanger until the plurality of shoulders are positioned above the splines, the mandrel assembly can be rotated less than one full rotation and then set down such that the shoulders are set down onto individual splines of the series of splines to lock the mandrel assembly in place; and the tubular assembly of the tubing hanger comprises:

a cylindrical interlocking top ring;

a cylindrical interlocking bottom ring having an inner diameter and a bottom end, the interlocking bottom ring configured to reside below the interlocking top ring, wherein the series of splines extend from the inner diameter of the interlocking bottom ring; and a cylindrical chemical injection ring configured to generally reside below the interlocking bottom ring, wherein the splines extend downwardly away from the bottom end of the interlocking bottom ring, and said chemical injection ring extends around a portion of the splines that extends away from the bottom end of the interlocking bottom ring.

2. The tubing hanger system of claim 1, further comprising:

the chemical injection line, wherein the chemical injection line has an upper end and a lower end, wherein:

the upper end of the chemical injection line is in sealed fluid communication with a fluid channel extending along the tubing hanger and configured to receive an injection chemical; and the lower end of the chemical injection line extends to at least the tubing anchor.

3. The tubing hanger system at claim 2, wherein:

the lower end of the chemical injection line extends below the tubing anchor; and the chemical injection line passes through said at least one channel along the outer diameter of the tubing anchor as the chemical injection line extends below the tubing anchor.

4. The tubing hanger system of claim 1, wherein the mandrel assembly comprises:

a top mandrel defining a cylindrical body; and a bottom mandrel also defining a cylindrical body, wherein the plurality of shoulders are spaced radially about the top mandrel.

5. The tubing hanger system of claim 4, further comprising:

the chemical injection line, wherein the chemical injection line has an upper end and a lower end;

a first fluid channel extending through said interlocking top ring; and a second fluid channel extending through said bottom mandrel, wherein the upper end of the chemical injection line is in fluid communication with said second fluid channel such that fluid injected into said first fluid channel will flow through the second fluid channel and into the chemical injection line.

6. The tubing hanger system of claim 5, further comprising:

the tubing string threadedly connected to and supporting the tubing anchor, wherein the bottom mandrel is threadedly connected to the top mandrel, and wherein when the mandrel assembly is set down such that the shoulders are set down onto the splines, the mandrel assembly and connected tubing string are locked from further rotational and longitudinal movement.

7. The tubing hanger system of claim 6, wherein:

the chemical injection line is fabricated from stainless steel.

8. The tubing hanger system of claim 6, wherein the tubing anchor comprises:

an upper box connector for threadedly connecting the tubing anchor to the tubing string;

a lower pin connector slips between the upper box connector and the lower pin connector configured to be mechanically actuated by applying tension to the tubing string; and a locking body having profiles configured to receive a pin and to hold the slips in engagement with the production casing during use upon rotation of the tubing string by less than 180 degrees; and wherein said at least one channel for receiving the chemical injection line is provided along an outer diameter of the locking body.

9. The tubing hanger system of claim 1, wherein the tubing anchor comprises:

an upper box connector for threadedly connecting the tubing anchor to the tubing string;

a lower pin connector for threadedly connecting the tubing anchor to the tubing string;

slips between the upper box connector and the lower pin connector configured to be mechanically actuated by applying tension to the tubing string; and a locking body having profiles configured to receive a pin and to hold the slips in engagement with the production casing during use upon rotation of the tubing string by less than 180 degrees; and wherein said at least one channel for receiving the chemical injection line is provided along an outer diameter of the locking body.

10. The tubing hanger system of claim 9, wherein the slips define upper slip segments and lower slip segments, and the tubing anchor further comprises:

a cone slidably residing over the slips; and an upper slip body configured to urge actuation of the upper slip segments in response to shearing of a shear pin;

wherein the locking body includes a lower slip body configured to urge actuation of the lower slip segments in response to a force provided by movement of the cone; and wherein said at least one channel for receiving the chemical injection line therethrough comprises channels in the cone, the upper slip body and the lower slip body.

11. A method of hanging a string of production tubing within a wellbore, in tension, comprising:

threadedly connecting a tubing anchor to the string of production tubing proximate a lower end of the string;

running the string of production tubing into the wellbore until the tubing anchor is at a desired depth within a production casing within the wellbore;

threadedly connecting a tubing hanger to an upper end of the string of production tubing, wherein the tubing hanger comprises:

a tubular assembly having:

an inner diameter and an outer diameter, with a shoulder along the outer diameter dimensioned to land on an inner surface of a tubing head above the wellbore; and a series of radially-disposed splines extending axially along the inner diameter of the tubular assembly and forming axially-extending spaces there between; and a mandrel assembly defining a tubular body and configured to be slidably received within a bore of the tubular assembly, the mandrel assembly having a series of radially-disposed shoulders along an outer diameter of the mandrel assembly, wherein the upper end of the string of production tubing is threadedly connected to a lower end of the mandrel assembly;

setting the tubing anchor within the production casing; and setting the tubing hanger within the tubing head by raising the mandrel assembly within the tubular assembly such that the shoulders on the mandrel assembly pass upwardly through the axially-extending spaces between the splines such that tension is applied to the tubing string and, when the shoulders are above the splines, rotating the mandrel assembly and connected tubing string less than one full rotation and then setting the shoulders down onto individual splines to rotationally and longitudinally lock the tubing string within the tubing head, wherein the mandrel assembly further comprises:

an upper end configured to extend above the tubular assembly when the shoulder on the tubular assembly of the tubing hanger lands on the inner surface of the tubing head;

a threaded lower end; and a bore extending from the upper end to the lower end, axially aligned with a bore of the tubing head, wherein threadedly connecting the tubing hanger to the string of production tubing comprises threadedly connecting the uppermost joint upper end of the string of production tubing to the lower end of the mandrel assembly, wherein the tubular assembly of the tubing hanger further comprises:

a cylindrical interlocking top ring;

a cylindrical interlocking bottom ring having an inner diameter and a bottom end, the interlocking bottom ring positioned below the interlocking top ring, wherein the series of splines are locating along the inner diameter of the interlocking bottom ring; and a cylindrical chemical injection ring positioned below the interlocking bottom ring, and wherein the splines extend downwardly away from the bottom end of the interlocking bottom ring, and the chemical injection ring extends around a portion of the splines that extends away from the bottom end of the interlocking bottom ring.

12. The method of claim 11, wherein:

setting the tubing anchor within the production casing comprises rotating the string of production tubing by less than 180°; and setting the tubing hanger within the tubing head comprises rotating the string of production tubing by less than 180° while applying tension to the string of production tubing.

13. The method of claim 11, further comprising:

clamping a chemical injection line along the string of production tubing while the string of production tubing is being run into the wellbore, and wherein the chemical injection line has an upper end and a lower end, connecting the upper end of the chemical injection line to the tubing hanger such that the chemical injection line is in sealed fluid communication with a fluid channel extending along the tubing hanger and is configured to receive an injection chemical, and the lower end of the chemical injection line extends at least to the tubing anchor.

14. The method of claim 13, wherein:

the chemical injection line passes through a channel along an outer diameter of the tubing anchor.

15. The method of claim 13, wherein the mandrel assembly comprises:

a top mandrel defining a cylindrical body; and a bottom mandrel also defining a cylindrical body, wherein the angled shoulders are radially disposed about an outer diameter of the top mandrel.

16. The method of claim 15, wherein the fluid channel extending along the tubing hanger comprises a first fluid channel extending through the interlocking top ring, and a second fluid channel extending through the bottom mandrel and wherein the method further comprises injecting a chemical treatment fluid through the first channel in the interlocking top ring, flushing the splines in the interlocking bottom ring, through the second channel in the bottom mandrel, and into the chemical injection line.

17. The method of claim 15, wherein setting the tubing hanger within the tubing head further comprises:

placing the tubular assembly of the tubing hanger within an inner diameter of the tubing head such that the outer shoulder of the tubular assembly lands on said inner surface of the tubing head;

running the mandrel assembly with connected string of production tubing through the bore of the tubular assembly;

after the tubing anchor is set, raising the mandrel assembly and connected tubing string through the chemical injection ring until the radially-disposed shoulders on the mandrel assembly are within the interlocking top ring, thereby placing the string of production tubing in tension and positioning the shoulders over the splines;

rotating the mandrel assembly within the bore of the tubular assembly while the shoulders are above the splines; and setting down the mandrel assembly in order to lock the tubing hanger and connected tubing string within the production casing and prevent further longitudinal movement of the mandrel assembly within the wellbore.

18. The method of claim 17, wherein the tubing anchor comprises:

an upper box connector for threadedly connecting the tubing anchor to the tubing string;

a lower pin connector;

slips between the upper box connector and the lower pin connector configured to be mechanically actuated by applying tension to the tubing string;

a locking body having profiles configured to receive a pin and to hold the slips in engagement with the production casing upon rotation of the tubing string by less than 180 degrees; and at least one channel on the tubing anchor through which said chemical injection line passes, wherein said at least one channel is provided along an outer diameter of the locking body.

19. The method of claim 18, wherein the slips define upper slip segments and lower slip segments, and the tubing anchor further comprises:

a cone slidably residing over the slips; and an upper slip body configured to urge actuation of the upper slip segments in response to shearing of a shear pin, wherein the locking body includes a lower slip body configured to urge actuation of the lower slip segments in response to a force provided by movement of the cone, and wherein said at least one channel through which said chemical injection line passes comprises channels in the cone, the upper slip body and the lower slip body.

20. The method of claim 14, wherein the chemical injection line terminates proximate a downhole pump below the tubing anchor within the well bore.

21. The method of claim 11 further comprising:

producing hydrocarbon fluids through the string of production tubing and up to the tubing anchor.

22. A tubing hanger system for suspending a production tubing string within a wellbore, the tubing hanger system having a tubing hanger adapted to land within a bore of a tubing head over the wellbore and to be operably connected to an upper end of the tubing string in order to gravitationally support the tubing string in tension, said tubing hanger comprising:

a tubular assembly having an inner diameter and an outer diameter, with a shoulder along the outer diameter configured to land on an inner surface of the tubing head when the tubular assembly is positioned within the bore of the tubing head;

a series of radially-disposed splines extending axially along the inner diameter of the tubular assembly and forming axially-extending spaces between adjacent splines; and a mandrel assembly defining a tubular body configured to be connected to the upper end of the tubing string and to be slidably received within and supported by the tubular assembly for supporting the tubing string in tension, the mandrel assembly having a series of radially-disposed shoulders along an outer diameter thereof, wherein the radially-disposed shoulders of the mandrel assembly are adapted to:

pass through the axially-extending spaces between the splines in the tubular assembly as the mandrel assembly is moved axially upward within the tubular assembly, and once the shoulders are moved upwardly out of the axially-extending spaces and the mandrel assembly then rotated, to be set down onto individual splines for rotationally and longitudinally locking the tubing string within the tubing head, thereby allowing the tubing hanger to be set through a rotation of the tubing string that is less than one full rotation, wherein the tubular assembly of the tubing hanger further comprises:

an interlocking top ring, an interlocking bottom ring having an inner diameter and a bottom end, the interlocking bottom ring adapted to be secured to and below the interlocking top ring, wherein the series of splines are locating along the inner diameter of the interlocking bottom ring; and a chemical injection ring adapted to be secured to and below the interlocking bottom ring.

23. The tubing hanger system of claim 22, wherein the splines extend downwardly away from the bottom end of the interlocking bottom ring, and the chemical injection ring is adapted to be secured to the interlocking bottom ring such that the chemical injection ring extends around a portion of the splines that extends away from the bottom end of the interlocking bottom ring.

24. The tubing hanger system of claim 22, wherein the mandrel assembly comprises:

a top mandrel; and a bottom mandrel adapted to be secured to the top mandrel, wherein the angled shoulders are radially disposed about an outer diameter of the top mandrel.

25. The tubing hanger system of claim 22, further comprising a first fluid channel extending through the interlocking top ring, and a second fluid channel extending through a portion of the mandrel assembly, wherein, when the tubing hanger system is assembled, the first fluid channel is in fluid communication with the second fluid channel.

* * * * *